US011717119B2

(12) United States Patent
Van Varick et al.

(10) Patent No.: US 11,717,119 B2
(45) Date of Patent: Aug. 8, 2023

(54) COMBINATION COMMODE AND CHAIR

(71) Applicant: CVS Pharmacy, Inc., Woonsocket, RI (US)

(72) Inventors: Robert Beale Van Varick, Yardley, PA (US); Donald Samuel Strum, Princeton, NJ (US); George Benjamin Wintner, Brooklyn, NY (US)

(73) Assignee: CVS Pharmacy, Inc., Woonsocket, RI (US)

( * ) Notice: Subject to any disclaimer, the term of this patent is extended or adjusted under 35 U.S.C. 154(b) by 0 days.

(21) Appl. No.: 17/404,662

(22) Filed: Aug. 17, 2021

(65) Prior Publication Data

US 2022/0047128 A1 Feb. 17, 2022

Related U.S. Application Data

(60) Provisional application No. 63/066,595, filed on Aug. 17, 2020.

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS

| | | | | |
|---|---|---|---|---|
| 3,829,908 | A * | 8/1974 | Thomas | A47K 11/04 211/208 |
| 3,854,773 | A * | 12/1974 | Thomas | A47K 11/04 297/411.3 |
| 4,052,087 | A * | 10/1977 | Gagliardi | A61G 5/1002 280/43 |
| 4,823,412 | A * | 4/1989 | Spiegel | A47K 11/04 4/240 |
| 5,526,537 | A | 6/1996 | Conrad | |
| 8,627,518 | B1 | 1/2014 | Lederer et al. | |
| 8,893,316 | B1 | 11/2014 | Smith | |
| D800,877 | S * | 10/2017 | Uche | D23/299 |
| 11,304,530 | B1 * | 4/2022 | Lin | A61G 5/1002 |
| 2007/0074338 | A1 * | 4/2007 | List | A47K 11/04 4/483 |

(Continued)

FOREIGN PATENT DOCUMENTS

| | | |
|---|---|---|
| CN | 2486094 | 4/2002 |
| CN | 201036530 | 3/2008 |

(Continued)

OTHER PUBLICATIONS

U.S. Appl. No. 29/818,918, filed Dec. 10, 2021, Van Varick et al.

(Continued)

*Primary Examiner* — Huyen D Le
(74) *Attorney, Agent, or Firm* — Sheridan Ross P.C.

(57) ABSTRACT

An illustrative commode is described to include a seat having an opening therein, a seat base connected with the seat and configured to allow the seat to move between an open position and a closed position, a leg assembly configured to support the seat base, where the leg assembly is configured to adjust a height of the seat base, and an armrest configured to at least partially rotate about the seat base and the leg assembly.

20 Claims, 20 Drawing Sheets

(56) References Cited

U.S. PATENT DOCUMENTS

| | | | | |
|---|---|---|---|---|
| 2007/0089227 | A1 | 4/2007 | Battiston | |
| 2007/0250999 | A1* | 11/2007 | Obitts | A47K 11/04 4/484 |
| 2011/0219529 | A1 | 9/2011 | Diamond | |
| 2011/0298263 | A1 | 12/2011 | Bateman et al. | |
| 2014/0130244 | A1 | 5/2014 | Schottenstein et al. | |
| 2015/0196178 | A1 | 7/2015 | Schottenstein et al. | |
| 2017/0172360 | A1 | 6/2017 | Schottenstein | |
| 2019/0069733 | A1* | 3/2019 | Rife | A47K 11/00 |

FOREIGN PATENT DOCUMENTS

| | | |
|---|---|---|
| CN | 204862932 | 12/2015 |
| CN | 207266706 | 4/2018 |
| CN | 208491944 | 2/2019 |
| CN | 208822639 | 5/2019 |
| CN | 210582341 | 5/2020 |
| JP | 2000-190768 | 7/2000 |
| JP | 2002-355142 | 12/2002 |
| JP | 2003-212022 | 7/2003 |
| JP | 2007-068575 | 3/2007 |
| JP | 2013-094180 | 5/2013 |

OTHER PUBLICATIONS

Official Action (no English translation available) for China Patent Application No. 202130819457.6, dated Feb. 24, 2022, 1 page.
Official Action (with English translation) for China Patent Application No. 202110946929.3, dated Jul. 26, 2022, 34 pages.
Notice of Allowance (with English translation) for China Patent Application No. 202130819457.6, dated May 31, 2022, 2 pages.
Notice of Allowance (with English translation) for China Patent Application No. 202230266549.0, dated Aug. 1, 2022, 3 pages.
Official Action (with English translation) for China Patent Application No. 202110946929.3, dated Mar. 21, 2023, 27 pages.

* cited by examiner

COMBINATION COMMODE AND CHAIR

CROSS REFERENCE TO RELATED APPLICATIONS

This application claims the benefit of and priority, under 35 U.S.C. § 119(e), to U.S. Provisional Application No. 63/066,595, filed on Aug. 17, 2020, and entitled "Combination Commode and Chair," the entire disclosure of which is hereby incorporated herein by reference, in its entirety, for all that it teaches and for all purposes.

BACKGROUND

The present disclosure is generally directed to sanitary engineering and specifically relates to commodes.

While the general functionality provided by toilets is basic, toilet fixtures come in many shapes, colors, and designs. Most toilet fixtures have a geometry that aims to provide ergonomic fit and comfort. The variation in shapes, colors, and designs is intended to provide a myriad of design options to users since toilets are a household fixture.

Portable toilets, also referred to as commodes, do not share the design variability that is seen in toilet fixtures. Perhaps one reason for the lack of attention to design is that commodes are not as widely used as compared to toilet fixtures. Rather, commodes are traditionally used in a healthcare setting by individuals with health conditions or a limited range of motion. There may also be a stigma attached to the use of commodes, since their use implies the person is elderly or unable to use a traditional toilet fixture for one reason or another.

BRIEF SUMMARY

It is with respect to the above issues and other problems that the examples presented herein were contemplated. The present disclosure provides a commode that is ergonomically comfortable, functions like a traditional commode, but also provides an enhanced aesthetic. It is also an object of the present disclosure to provide a commode that is configured to work in cooperation with both an elongated toilet fixture as well as a round toilet fixture. The disclosed commode may be configured to sit around/above a traditional toilet fixture and integrate with the bowl of either an elongated toilet fixture or round toilet fixture. The disclosed commode may also be configured to work in the absence of a toilet fixture, much like a traditional commode.

In one aspect, a commode is provided that includes: a seat having an opening therein, a seat base connected with the seat and configured to allow the seat to move between an open position and a closed position, a leg assembly configured to support the seat base, where the leg assembly is configured to adjust a height of the seat base, and an armrest configured to at least partially rotate about the seat base and the leg assembly.

Examples may include one of the following features, or any combination thereof

The commode may further include a back tube connected with the leg assembly, where the back tube is configured to receive the armrest and provide a pivot point for the armrest. Illustratively, the leg assembly may include a first leg assembly and a second leg assembly, the armrest may include a first armrest and a second armrest, the first armrest may be configured to rest upon the first leg assembly and rotate around an outer side of the first leg assembly, and the second armrest may be configured to rest upon the second leg assembly and rotate around an outer side of the second leg assembly.

The first armrest may rotatably and slidably interface with the back tube at a first pivot point and the second armrest may rotatably and slidably interface with the back tube at a second pivot point. The first pivot point and the second pivot point may be provided on a common axis of rotation.

The commode may further include a backrest that is configured to interface with the seat base and is further configured to be supported by the back tube.

The seat base may be connected with the seat by a hinge or multiple hinges.

The commode may further include a splash guard that sits beneath the seat and within the seat base. The splash guard may be further configured to extend through the seat base.

The commode may further include a bucket that sits beneath the seat and within the seat base. The bucket may be further configured to extend through the seat base. The bucket may further include a handle and the handle may include one or more indents that provide an ergonomic grip for the handle and that provide a point of hanging stabilization for the bucket when the bucket is hung from the handle.

The seat base may include a cascading seat front that transitions downwardly from a plane that is substantially parallel with the seat when the seat is in the closed position.

In one aspect, a commode is provided that includes: a seat frame; a seat comprising an opening therein; a seat base supported on the seat frame and connected with the seat, the seat base configured to allow the seat to move between an open position and a closed position; a leg assembly configured to support the seat base, wherein the leg assembly is configured to adjust a height of the seat base; and an armrest configured to at least partially rotate about the seat base and the leg assembly.

Examples may include one of the following features, or any combination thereof

The armrest may be releasably secured to a receiver fixed to the seat frame by a trigger.

The receiver may comprise an aperture. The trigger may comprise a biased pin receivable in the aperture. The armrest may be rotatable when the pin is not positioned in the aperture and the armrest may be fixed when the pin is positioned in the aperture.

The trigger may further comprise a knob. The trigger may be actuated when a force is applied to the knob to pull the knob away from the receiver. When the force applied to the knob exceeds a biasing force, the pin may be pulled away from the receiver.

The leg assembly may comprise a leg having an inner tube slidable in an outer tube, a plurality of apertures disposed on the outer tube, and a biased pin coupled to the inner tube. The biased pin may be configured to be received by one of the plurality of apertures to lock the inner tube to the outer tube.

The commode may further comprise a lid connected to the seat base and movable between an open position and a closed position The lid may cover the seat when in the closed position.

The lid may comprise a plurality of grips for increasing friction at an interface between the lid and the seat.

In one aspect, a commode is provided that includes: a seat frame comprising a first curved tube coupled to a second curved tube by at least one cross tube and a back tube coupled to the second curved tube by at least one lateral tube; at least one leg assembly comprising a leg having an adjustable height; a seat assembly supported by the seat frame and the at least one leg assembly, the seat assembly comprising a seat pivotably coupled to a seat base and a backrest; and at least one arm rest assembly supported by the seat frame, the at least one arm rest assembly comprising an arm rest frame pivotably coupled to the back tube and releasably securable to the first curved tube.

Examples may include one of the following features, or any combination thereof

The backrest may be configured to be removable from the seat frame. The backrest may comprise at least one bracket to secure the backrest to the back tube and at least one fastener to secure the backrest to the second curved tube.

The commode may further comprise a splash guard fitted within the seat base and under the seat.

The seat base may comprise a seating surface and a front lip curving downward from the seating surface. The front lip may be configured to at least partially cover a view of a toilet fixture when the commode is fixed to a toilet fixture.

The preceding is a simplified summary of the disclosure to provide an understanding of some aspects of the disclosure. This summary is neither an extensive nor exhaustive overview of the disclosure and its various aspects, examples, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, examples, and configurations of the disclosure are possible utilizing, alone or in combination, one or more of the features set forth above or described in detail below. All examples and features mentioned above can be combined in any technically possible way.

Additional features and advantages are described herein and will be apparent from the following Detailed Description and the figures.

DETAILED DESCRIPTION

Before any examples of the disclosure are explained, it is to be understood that the disclosure is not limited in its application to the details of construction and the arrangement of components set forth in the following description or illustrated in the following drawings. The disclosure is capable of other examples and of being practiced or of being carried out in various ways.

Also, it will be appreciated that the claims of the instant application are not limited to the ornamental design of the various articles and examples shown in the accompanying figures. Moreover, the figures are not intended to illustrate the only available ornamental design of the various articles and examples described herein. As can be appreciated by a person having ordinary skill in the art, any number of alternative design options are available for the disclosed articles that could achieve the same functionality as described and/or claimed herein.

Further, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Referring now to FIGS. 1A-11, various components and configurations of a commode 100 will be described in accordance with examples of the present disclosure.

Figure 1A:
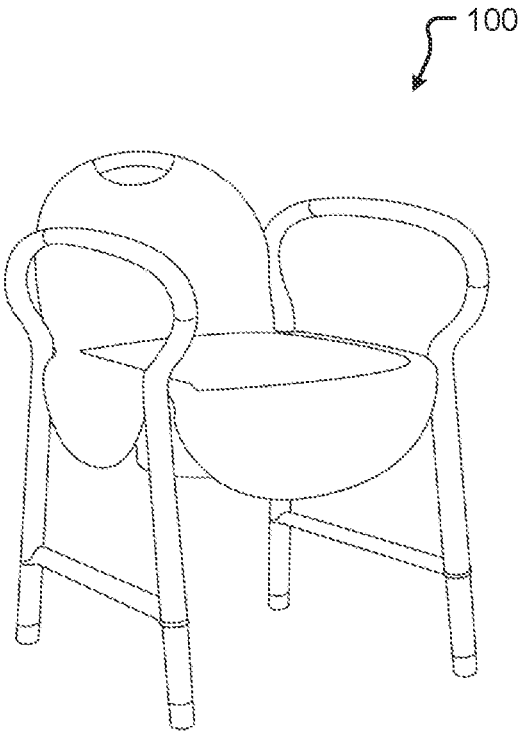
FIG. 1A is a perspective view of an illustrative commode in accordance with examples of the present disclosure.
Figure 1B:
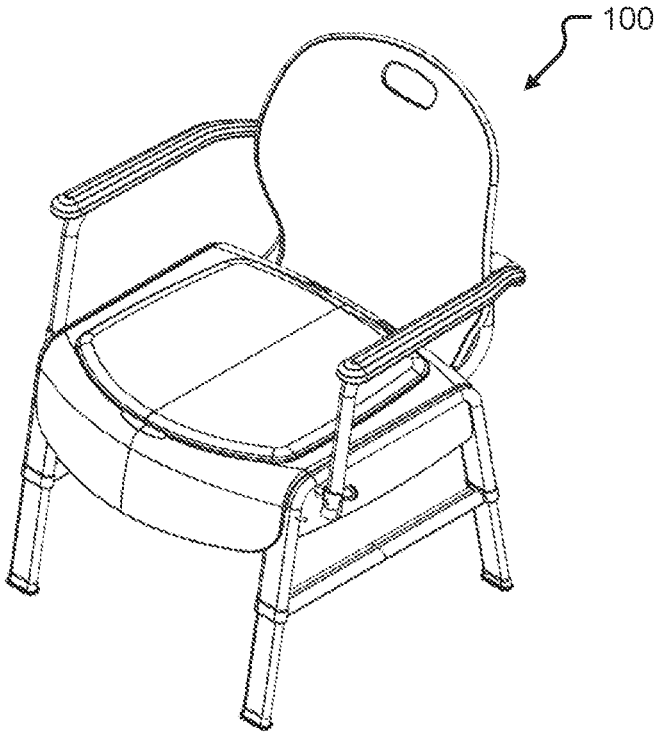
FIG. 1B is a perspective view of another illustrative commode in accordance with examples of the present disclosure.

As shown in FIGS. 1A and 1B, an illustrative commode 100 may be configured to look like a traditional chair or seat. In this way, the commode 100 may be better suited for use in a residential setting as compared to traditional commodes, which are primarily designed for healthcare settings and do not look like residential furniture.

The illustrative commodes 100 may be configured to operate in connection with a toilet fixture or to operate independently (e.g., without a toilet fixture). The illustrative commodes 100 described herein may also be configured to move between different operational positions, thereby enabling users the ability to more easily sit onto the commode 100, sit up from the commode 100, and/or clean themselves. The illustrative commodes 100 may also be provided with a design that is both functional and aesthetically pleasing.

The depicted commode 100 is shown to interface or work in conjunction with a toilet fixture, meaning that the commode 100 does not necessarily need to be permanently fixed with a waste bucket. Instead, the commode 100 may include a number of components that enable interoperability with a bowl of a toilet fixture. The commode 100 may be designed to interface with an elongated bowl or a circular bowl without departing from the scope of the present disclosure.

Figure 2:
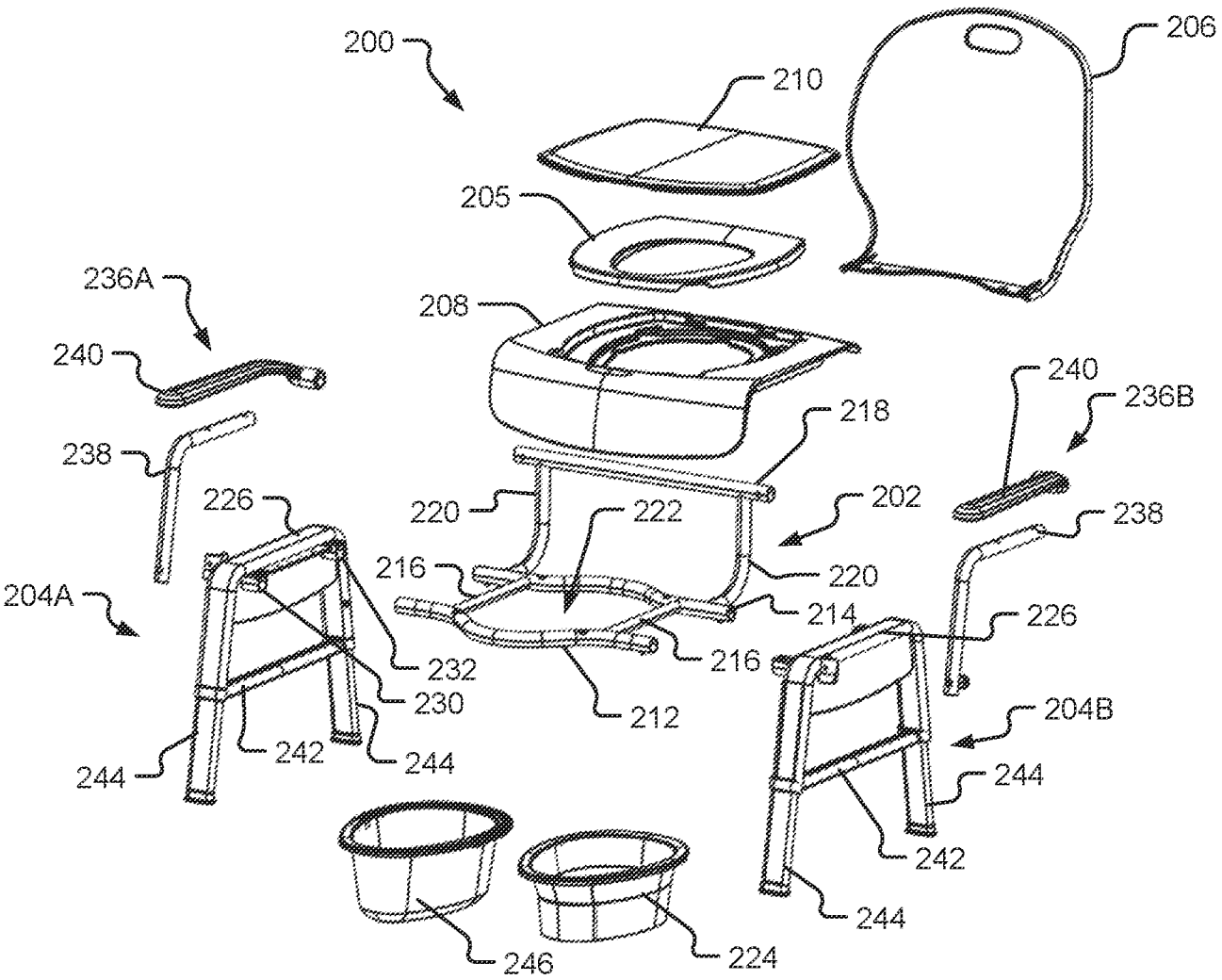
FIG. 2 is an exploded component view of a commode in accordance with examples of the present disclosure.

FIG. 2 illustrates a perspective exploded view of at least some possible components of a commode 100. The commode 100 may comprise a seat assembly 200 supported by a seat frame 202, a first leg assembly 204A, and a second leg assembly 204B. The seat assembly 200 comprises a backrest 206, a seat base 208, a seat 205 supported on the seat base 208, and a lid 210 that can cover at least a portion, or an entirety, of the seat 205. The seat frame 202 comprises a first curved tube 212 and a second curved tube 214 coupled by a pair of cross tubes 216. In some examples, the second curved tube 214 may be bent outwardly toward the rear of the commode 100 while the first curved tube 212 may be bent outwardly toward the front of the commode 100. The first curved tube 212, the second curved tube 214, and the pair of cross tubes 216 form an opening 222 through which a splash guard 224 and/or the seat base 208 may be received and supported by the first curved tube 212, the second curved tube 214, and/or the pair of cross tubes 216. The first curved tube 212, the second curved tube 214, and/or the pair of cross tubes 216 may also support the seat base 208, which may be positioned over the splash guard 224.

The seat frame 202 also comprises a back tube 218 coupled to the second curved tube 214 by a pair of curved lateral tubes 220. The back tube 218 may support the backrest 206 when the backrest 206 is in an upright position. The back tube 218 may also provide support for a user's back when a user leans against the backrest 206. The pair of curved lateral tubes 220 may connect the second curved tube 214 to the back tube 218 and create a gap between the second curved tube 214 and the back tube 218. The seat base 208 may extend at least partially into the gap between the second curved tube 214 and the back tube 218.

The seat frame 202 may be coupled at a first side to the first leg assembly 204A and at a second side to the second leg assembly 204B. It will be appreciated that in some examples the commode 100 may include one leg assembly, two leg assemblies, or more than two leg assemblies. In some examples, the first leg assembly 204A and the second leg assembly 204B are identical to each other. In other examples, the first leg assembly 204A may include fewer or more components than the second leg assembly 204B. In still other examples, one or more components of the first leg assembly 204A may differ in size, shape, or functionality than the second leg assembly 204B.

Each of the first leg assembly 204A and the second leg assembly 204B comprise a leg frame 226 having a first receptacle 230 and a second receptacle 232 for receiving the first curved tube 212 and the second curved tube 214. The leg frame 226 includes a planar portion and two extensions that bend at and extend from a first end and a second end of the planar portion, as will be described in more detail with respect to FIGS. 8, 9A, and 9B. Each of the first leg assembly 204A and the second leg assembly 204B may also comprise a cross member 242 to provide additional structural support to the leg frame 226 and a pair of legs 244 extendable from the leg frame 226.

The seat frame 202 and the leg assemblies 204A, 204B may provide the structure of the commode 100 that supports the weight of a user. In some examples, the seat frame 202 and the leg assemblies 204A, 204B may support a user of 350 lbs or more. While some components of the seat frame 202 and the leg assemblies 204A, 204B are described as a tube, it should be appreciated that the seat frame 202 and the leg assemblies 204A, 204B are not limited to using tube-shaped components. Rather, it should be appreciated that the components of the seat frame 202 and the leg assemblies 204A, 204B may be provided in any suitable shape or structural configuration (e.g., rectangular tube, beam, square tube, round tube, polygonal-shaped tube, solid bar, etc.). The particular shape of the components used for the seat frame 202 and the leg assemblies 204A, 204B may vary based on design preferences and/or structural requirements.

The commode 100 may also include a first arm rest assembly 236A and a second arm rest assembly 236B. It will be appreciated that in some examples, the commode 100 may include zero, one, or more than one arm rest assembly. Each of the first arm rest assembly 236A and the second arm rest assembly 236B may each include an arm rest frame 238 and an arm rest cover 240. The arm rest frame 238 may include an elongate portion for supporting an arm of a user and a lateral portion for coupling the arm rest frame 238 to a corresponding leg assembly 204A, 204B.

As illustrated, the commode 100 may also include a bucket 246, which will be described with respect to FIGS. 10 and 11. In some examples, the commode 100 may not include the bucket 246.

Figure 3:
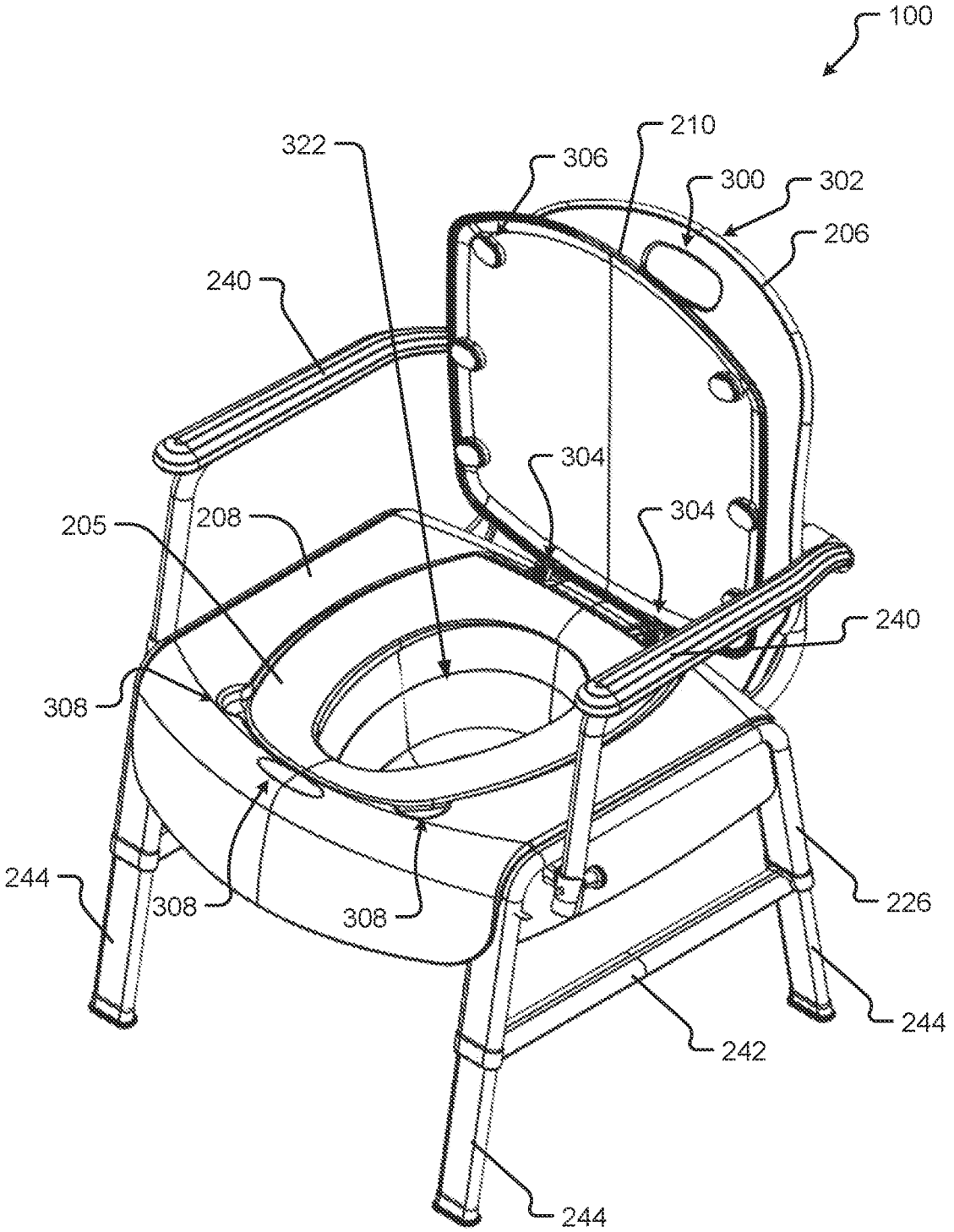
FIG. 3 is a perspective view of a commode in accordance with examples of the present disclosure.

Turning to FIG. 3, a perspective view of the commode 100 with the lid 210 in an upright or open position is shown. The commode 100 includes various features for facilitating ease of use of the commode 100. In the illustrated example, the backrest 206 may include an opening 300 to form a handle 302. The handle 302 may assist a user in handling or moving the commode 100. Also shown in the illustrated example, the seat base 208 may include indents 308 adjacent to the seat 205 and the lid 210 to facilitate lifting or moving of the seat 205 and/or the lid 210. Among other things, these indents 308 may be sized to receive a tip of one or more fingers of a user such that the user can contact an underside portion, or edge, of the seat 205 and/or the lid 210. In other examples, the seat base 208 may not include the indents 308 or may include one indent, two indents, or more than two indents.

As shown, the lid 210 and the seat 205 are each pivotable at a pair of hinges 304 between a first position (e.g., a closed position) and a second position (e.g., an open position). The lid 210 may cover an opening 322 when in the first position (shown in FIG. 1B) and may be upright and near the backrest 206 when in the second position (shown in FIG. 3). The opening 322 formed by the seat 205 may be aligned, and/or concentric, with the opening 222 formed by the seat frame 202 and an opening of the splash guard 224. In examples where the bucket 246 is not installed, the seat 205 may open to a bowl of a toilet fixture. In examples where the bucket 246 is installed, then the seat 205 may open to the bucket 246.

The seat 205 and the seat base 208 are shown and described in a particular configuration (or shown to have a particular configuration or shape), however, it should be appreciated that this is one of many possible configurations or shapes. The seat 205 may include a top sitting surface that is substantially flush with a top of the seat base 208 when in the first or closed position, creating an appearance of a unitary sitting surface when the seat 205 is closed. The lid 210 may then rest on the seat 205 and/or on the seat base 208. The seat base 208 may also comprise a cascading seat front that transitions downwardly from a plane that is substantially parallel with the seat 205 when the seat 205 is in the closed position.

The lid 210 is shown and described below in a particular configuration (or shown to have a particular configuration or shape), however, it should be appreciated that this is one of many possible configurations or shapes. The lid 210 may completely cover the seat 205 when the lid 210 and seat 205 are both in the first, or closed, position. As will be discussed further herein, the lid 210, when in an open, or second, position, may be configured to rest against a tank of the toilet fixture, against the backrest 206, or against the back tube 218. The seat 205 may rest against the lid 210 in an open, or second, position. Alternatively or additionally, the lid 210 may be removed from the commode 100 such that the seat 205, when in an open, or second, position, may be configured to rest against a tank of a toilet fixture, against the backrest 206, or against the back tube 218.

The lid 210 may include a plurality of seat grips 306 for improving an interface between the lid 210 and the seat 205 when the lid 210 is in the first or closed position. The seat grips 306 may prevent the lid 210 from moving or slipping on the seat 205 when the commode 100 is used, for example, as a chair and the lid 210 is used as a seating surface. The seat grips 306 may protrude or extend from the lid 210. In other instances, the seat grips 306 may be substantially in-line with the lid 210. The seat grips 306 may include one or multiple non-slip pads of material that grip and maintain placement on a hard plastic surface. The seat grips 306 may be constructed of silicone and/or Thermoplastic Elastomers (TPE). In some examples, the seat grips 306 may be integral or co-molded with lid 210.

Figure 4B:
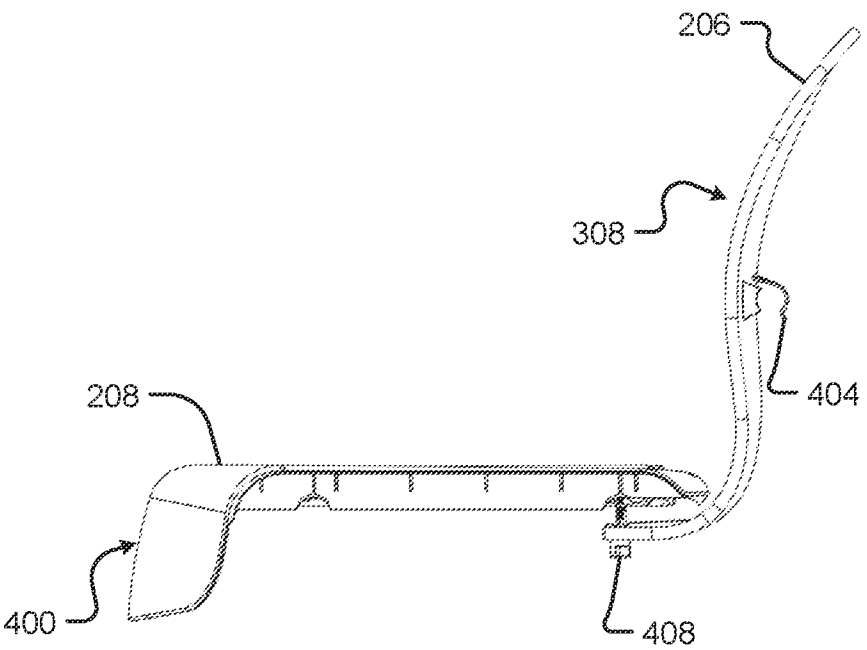
FIG. 4B is a side view of a seat assembly in accordance with examples of the present disclosure.
Figure 4A:
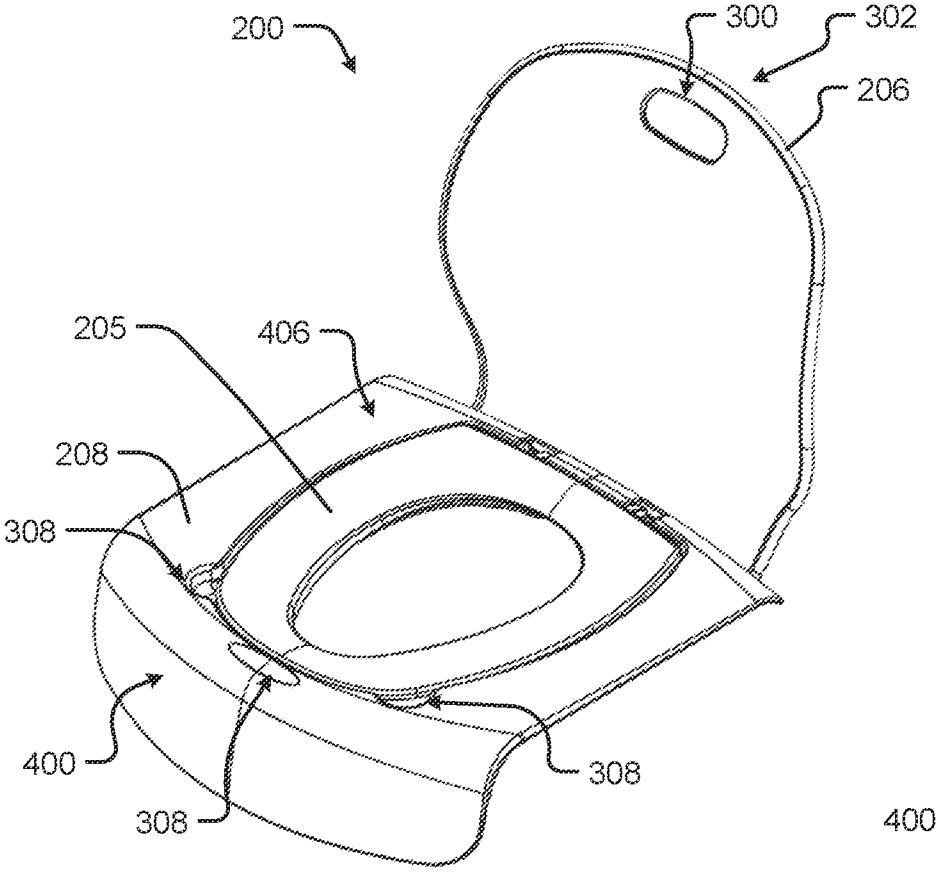
FIG. 4A is a perspective view of a seat assembly in accordance with examples of the present disclosure.

Turning to FIGS. 4A and 4B, a perspective view and a side view, respectively, of the seat assembly 200 are shown. The lid 210 is not shown in FIGS. 4A and 4B for clarity in disclosure. The seat base 208 and the seat 205 form a seating surface 406 that is contoured for ergonomic comfort and to reflect a toilet seat of a toilet fixture. A front lip 400 is shown and described below in a particular configuration (or shown to have a particular configuration or shape), however, it should be appreciated that this is one of many possible configurations or shapes. The seat base 208 includes a front lip 400 that curves downward from the seating surface 406. The front lip 400 may at least partially cover a view of a toilet seat of a toilet fixture when the commode 100 is installed onto a toilet fixture. In other instances when the commode 100 is not installed on a toilet fixture, the front lip 100 may at least partially cover a view of the splash guard 224 and/or the bucket 246 (if the bucket 246 is installed in the commode 100). By covering these components, the front lip 400 may contribute to a chair-like appearance of the commode 100 whether the commode 100 is in use or otherwise.

The backrest 206 is shown and described below in a particular configuration (or shown to have a particular configuration or shape), however, it should be appreciated that this is one of many possible configurations or shapes. The backrest 206, as shown in FIG. 4B, includes a curved profile for providing support and comfort for a user's back. The backrest 206 may also contribute to a chair-like appearance of the commode 100. The backrest 206 may be removable from the commode 100 by at least one bracket 404. Though not fully visible, the backrest 206 includes two brackets 404 and one or more fasteners 408 for securing the backrest 206 to the seat frame 202. Examples of the one or more fasteners 408 may include, but are in no way limited to, screws, bolts, threaded fasteners, quarter-turn fasteners, thumb screws, wing nuts and threaded rod fasteners, captured fasteners, quick-release fasteners, etc., and/or combinations thereof. The two brackets 404 may be in the shape of a hook and may be resilient and flexible.

When the backrest 206 is installed onto the seat frame, the brackets 404 may be pushed onto the back tube 218. The bracket 404 may bend, or flex, outwardly when the bracket 404 is pushed onto the back tube 218 and snap back over the back tube 218 when the back tube 218 is disposed in the bracket 404. The one or more fasteners 408 may then be fastened to the second curved tube 214, thereby securing the backrest 206 to the seat frame 202. Conversely, when the backrest 206 is removed from the seat frame 202, the one or more fasteners 408 may be unfastened from the second curved tube 214. The brackets 404 may also be removed from the back tube 218. The bracket 404 may bend outwardly when the bracket 404 is pulled off of the back tube 218 until the back tube 218 is no longer within the bracket 404. Easy removal and installation of the backrest 206 may provide for easy cleaning of the backrest 206 or simple removal of the backrest 206 when the backrest 206 is not desired.

Figure 5:
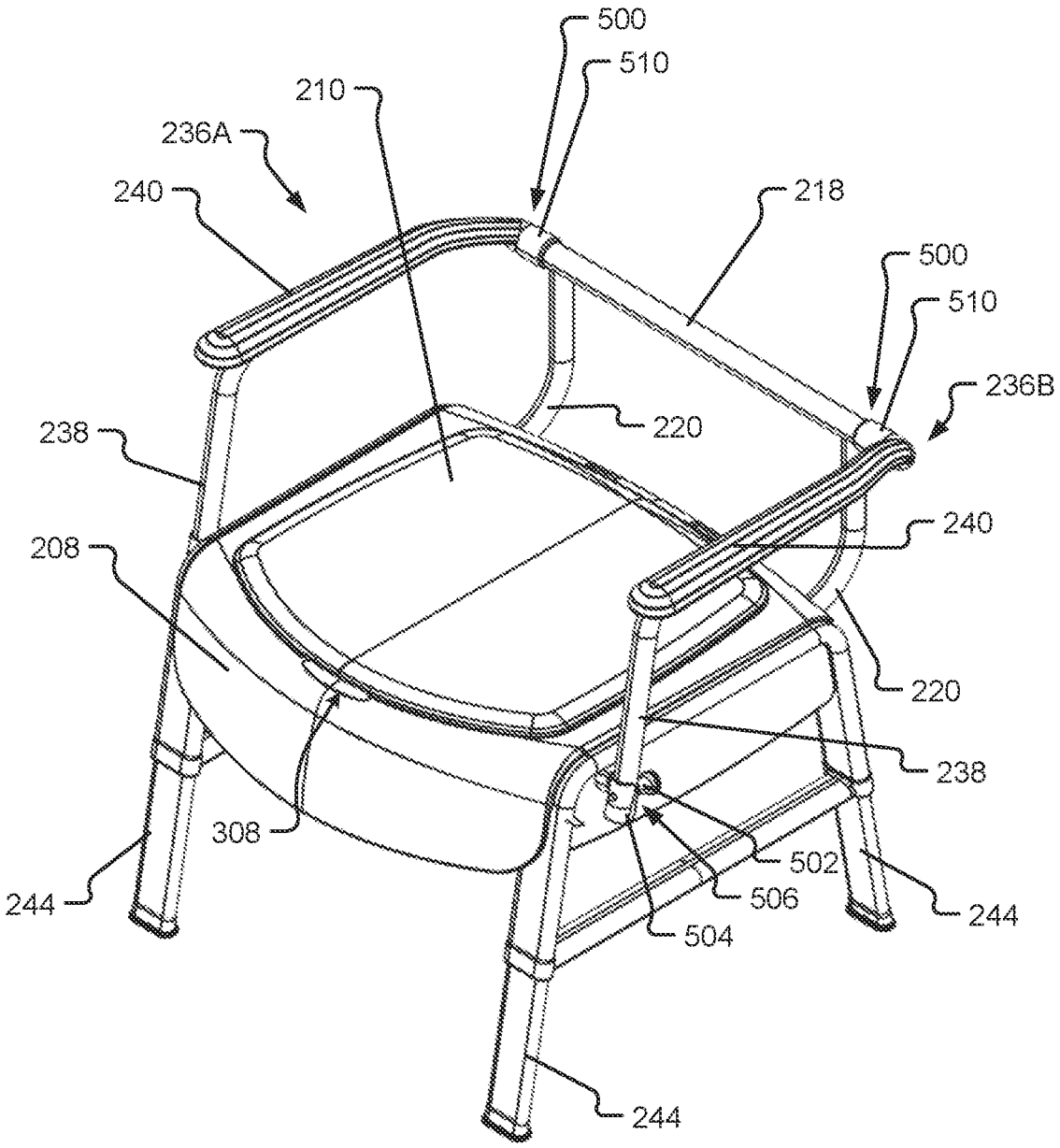
FIG. 5 is a perspective view of a commode with a backrest removed in accordance with examples of the present disclosure.

Turning to FIG. 5, a perspective view of the commode 100 without the backrest 206 is shown. As previously described, when the lid 210 is closed, the lid 210 and the seat base 208 may form a seating surface 406 resembling a seating surface of a chair or stool. As such, when the commode 100 is not in use, the commode 100 may appear as furniture, such as a chair. The lid 210 may also include a pad that provides a comfortable sitting surface for a user when the seat 205 and lid 210 are in a closed position. The pad may also contribute to the aesthetic of the commode 100 when the lid 210 is closed (e.g., by making the commode 100 appear as a padded chair rather than a portable toilet).

As shown, the first arm rest assembly 236A and the second arm rest assembly 236B each pivotably connect to the back tube 218 at a pivot point 500. The back tube 218 may provide pivot points 500 for each armrest assembly 236A, 236B. Specifically, but without limitation, each armrest assembly 236A, 236B may be provided with an armrest interface 510, which provides a physical connection between the armrest assembly 236A, 236B and the back tube 218. In some examples, the armrest interface 510 may be an integral part of the armrest assembly 236A, 236B. In other examples, the armrest interface 510 may be an integral part of the back tube 218. In yet other examples, the armrest interface 510 may correspond to a number of components in both the armrest assembly 236A, 236B and back tube 218 that cooperate with one another to connect the armrest assembly 236A, 236B to the back tube 218 and to provide the armrest pivot point 500.

Each of first arm rest assembly 236A and the second arm rest assembly 236B comprises a trigger 502 that releasably secures an end 506 of the arm rest frame 238 to a receiver 504 coupled to each of the leg assemblies 204A, 204B. When the trigger 502 is actuated, the arm rest frame 238 is released from the receiver 504 and is free to rotate or pivot (e.g., about an axis of the back tube, etc.).

Figure 6B:
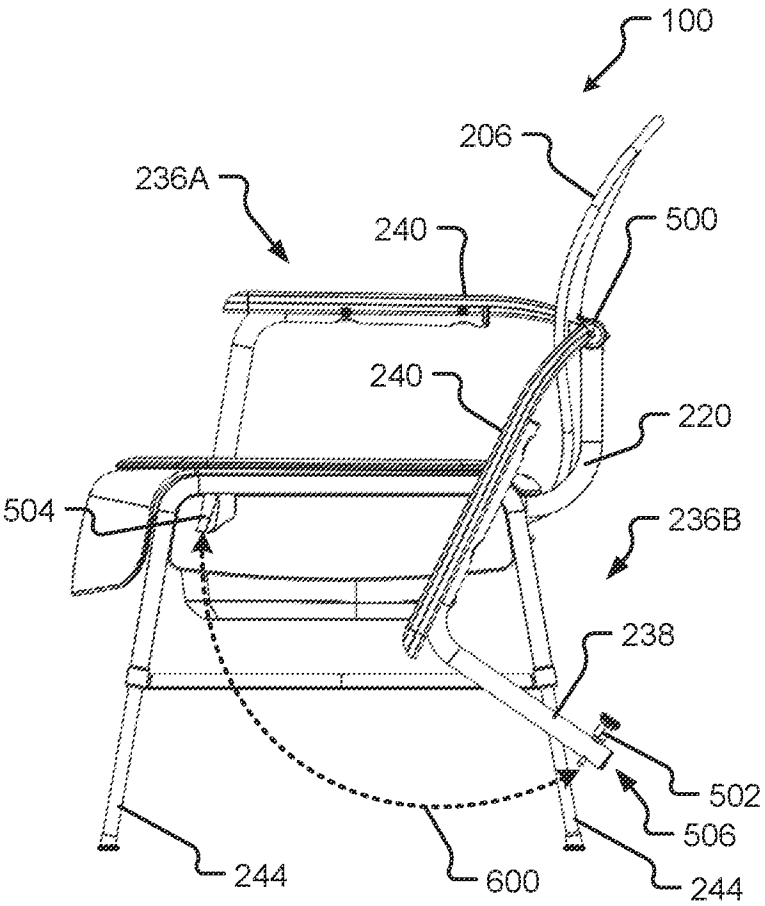
FIG. 6B is a side view of a commode with arm rests in a second configuration in accordance with examples of the present disclosure.
Figure 6A:
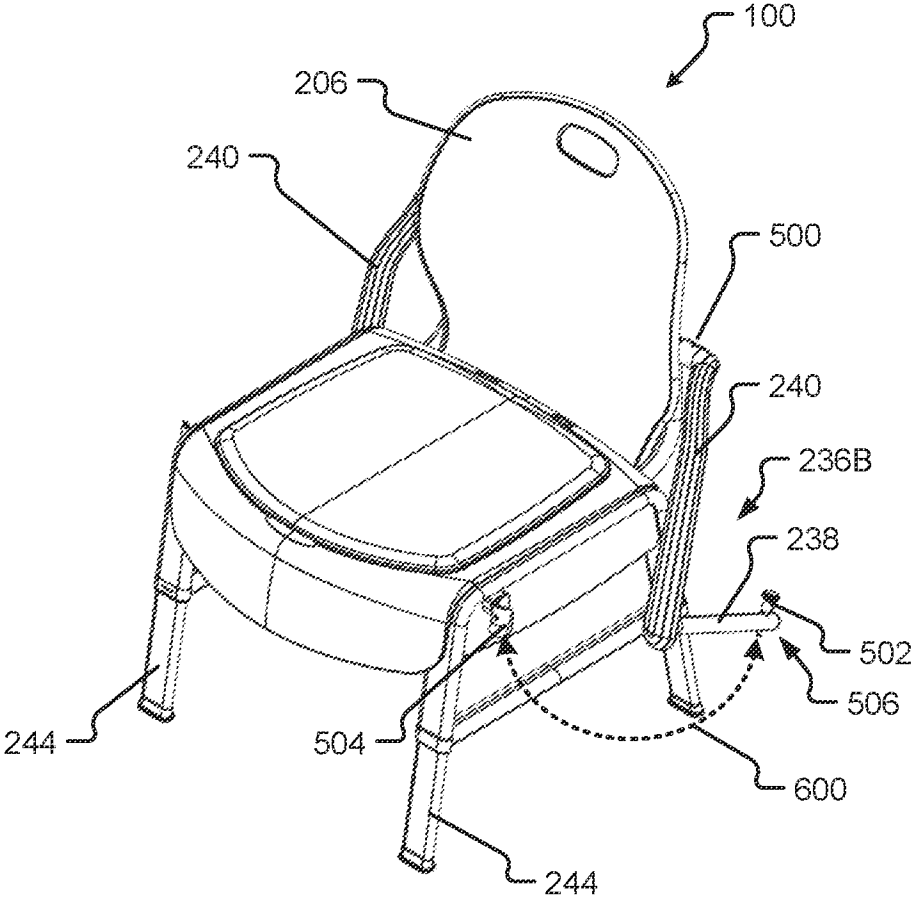
FIG. 6A is a perspective view of a commode with arm rests in a second configuration in accordance with examples of the present disclosure.

Turning to FIGS. 6A and 6B, a perspective view and a side view, respectively, of the commode 100 are shown. As illustrated, the first arm rest assembly 236A and the second arm rest assembly 236B are pivotable (e.g., about an axis of the back tube 218, etc.) between a first position and a second position along an arc 600. The first arm rest assembly 236A and the second arm rest assembly 236B are shown in the first position in FIG. 5, where the arm rest cover 240 is substantially parallel to the seat base 208. The first arm rest assembly 236A and the second arm rest assembly 236B are shown in the second position in FIG. 6A, where the first arm rest assembly 236A and the second arm rest assembly 236B are pivoted downward until the arm rest cover 240 is no longer parallel to the seat base 208. The second arm rest assembly 236B is shown in the second position in FIG. 6B, where the second arm rest assembly 236B is pivoted downward, along the arc 600, until the arm rest cover 240 is no longer parallel to the seat base 208. The first arm rest assembly 236A is shown in the first position in FIG. 6B. It may be desirable to position at least one of the first arm rest assembly 236A and the second arm rest assembly 236B in the second position when a user may have difficulty maneuvering around the first arm rest assembly 236A and/or the second arm rest assembly 236B. It may also be desirable to initially position the first arm rest assembly 236A and the second arm rest assembly 236B in the second position, until a user is positioned on the commode 100, and then pivot the first arm rest assembly 236A and the second arm rest assembly 236B back into the first position during use.

Figure 7A:
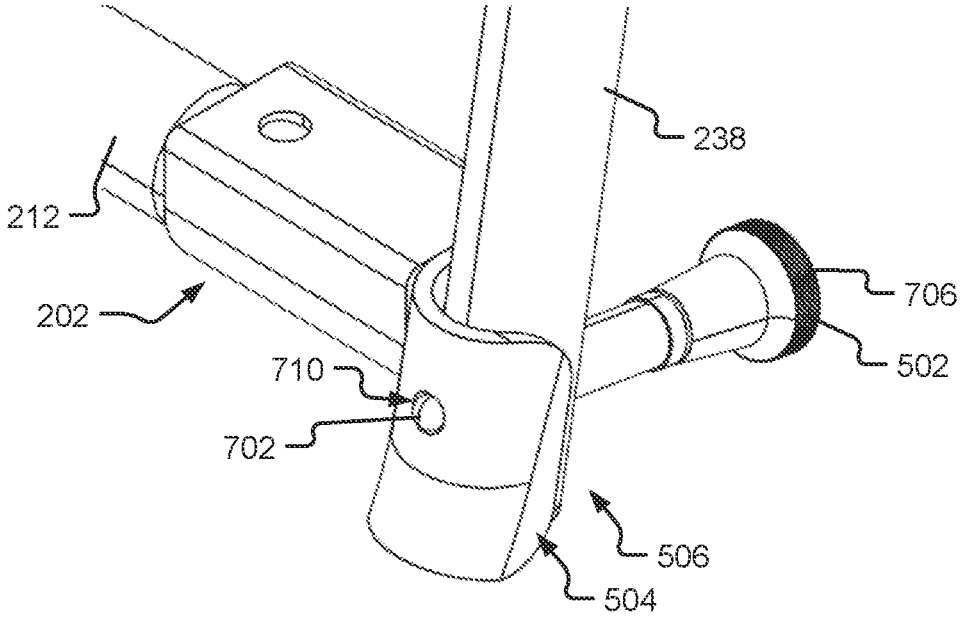
FIG. 7A is a close-up perspective view of components of a trigger in accordance with examples of the present disclosure.
Figure 7B:
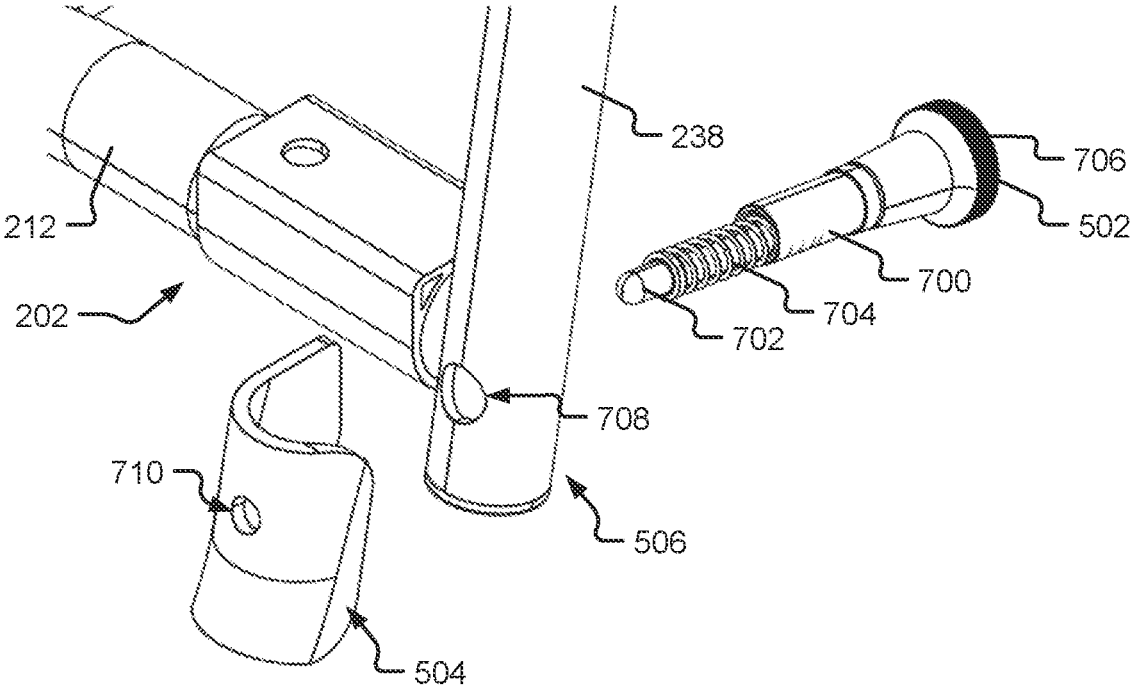
FIG. 7B is a close-up exploded perspective view of components of a trigger in accordance with examples of the present disclosure.

Turning to FIGS. 7A and 7B, a close-up perspective view and a close-up partially exploded perspective view of the trigger 502 and the receiver 504 are respectively shown. As previously described, the end 506 of the arm rest frame 238 is releasably coupled to the receiver 504 by the trigger 502. The receiver 504 is fixed to the first curved tube 212. When the trigger 502 is actuated, the arm rest frame 238 is released from the receiver 504 and becomes free to pivot as described.

The trigger 502 includes a knob 706, a housing 700, a pin 702 and a spring 704 disposed in the housing 700. The spring 704 exerts a biasing force onto the pin 702 to bias the pin 702 away from the knob 706. The pin 702 extends through an aperture 708 disposed on the arm rest frame 238 and an aperture 710 disposed on the receiver 504. When the pin 702 is disposed in the aperture 710, the arm rest frame 238 is locked to the seat frame 202 and rotation of the arm rest frame 238 is restricted. During actuation of the trigger 502, the knob 706 is pulled away from the receiver 504 and the force applied to pull the knob 706 overcomes the biasing force on the pin 702. When the biasing force on the pin 702 is exceeded by the force applied to the knob 706, the pin 702 is also pulled away from the receiver 504 until the pin 702 is not disposed in the aperture 710. When the pin 702 is not disposed in the aperture 710, the arm rest frame 238 is free to pivot. To reinsert the pin 702 into the aperture 710, the pin 702 is simply aligned with the aperture 710. The pin 702 will be moved by the biasing force into the aperture 710 when the applied force is removed.

Figure 8:
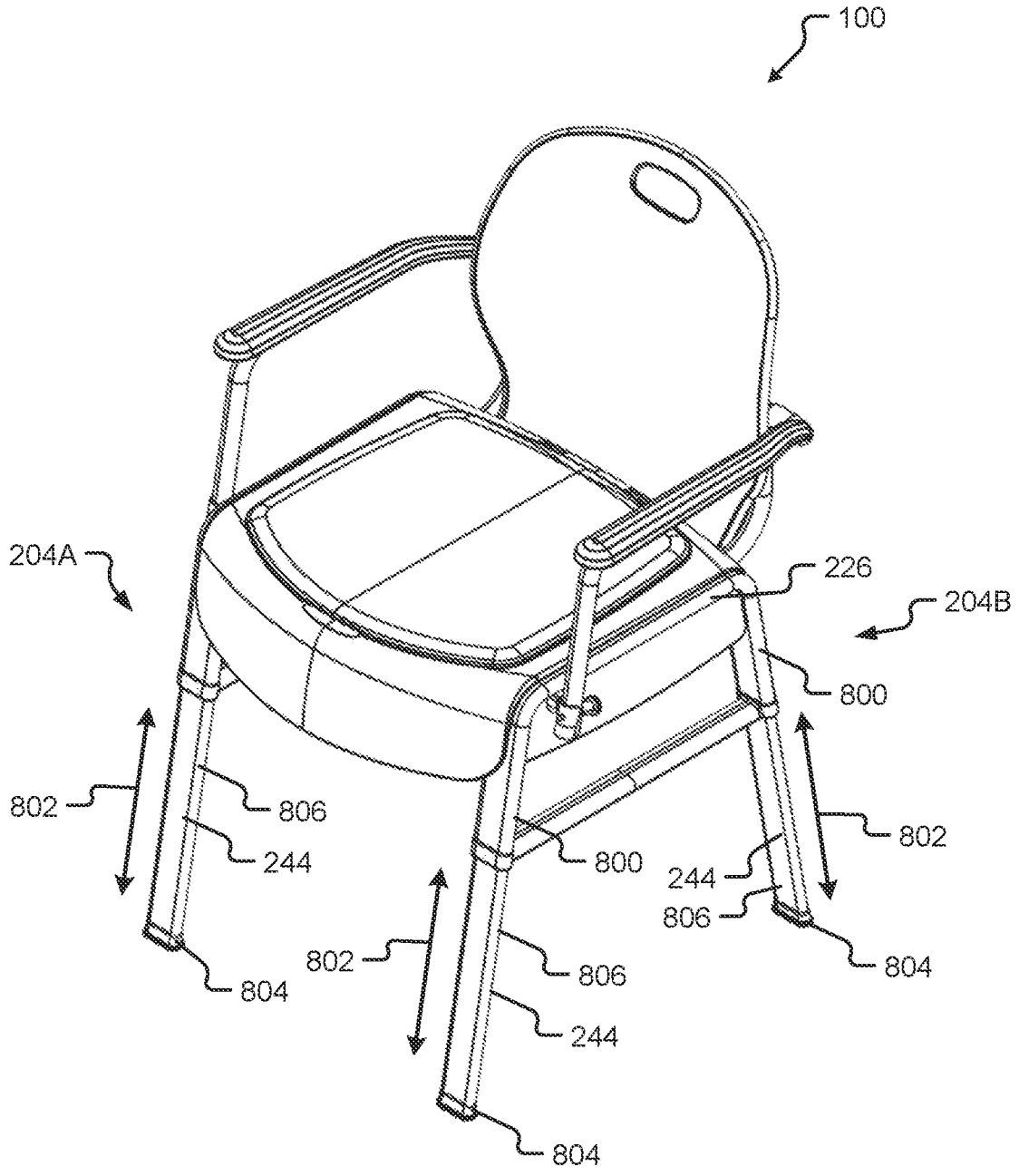
FIG. 8 is a perspective view of a commode with legs extended in accordance with examples of the present disclosure.

Turning to FIG. 8, a perspective view of the commode 100 is shown. Each of the leg assemblies 204A, 204B may be adjustable in height, meaning that each of the legs 244 in the leg assemblies 204A, 204B may include one or more height adjustment mechanisms that enable the total length of each leg 244 in the leg assemblies 204A, 204B to adjust from a minimum height to a higher maximum height. Height adjustability of the legs 244 in the leg assemblies 204A, 204B may enable the commode 100 to provide multiple sitting heights for a user as well as fit above/over a number of different toilet fixtures, which may vary in height from one type of toilet fixture to another type of toilet fixture. Illustratively, each leg 244 of the leg assemblies 204A, 204B may include an inner tube 806 that slides within an outer tube 800 to laterally adjust each leg 244 in the direction 802. Each leg 244 may also include a grip or pad 804 to increase a grip of the commode 100 on a ground surface.

Figure 9B:
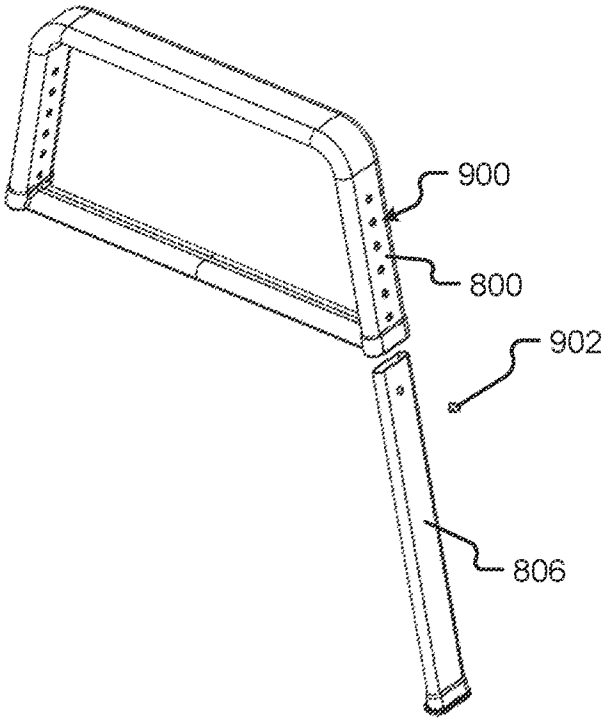
FIG. 9B is an exploded perspective view of a leg assembly in accordance with examples of the present disclosure.
Figure 9A:
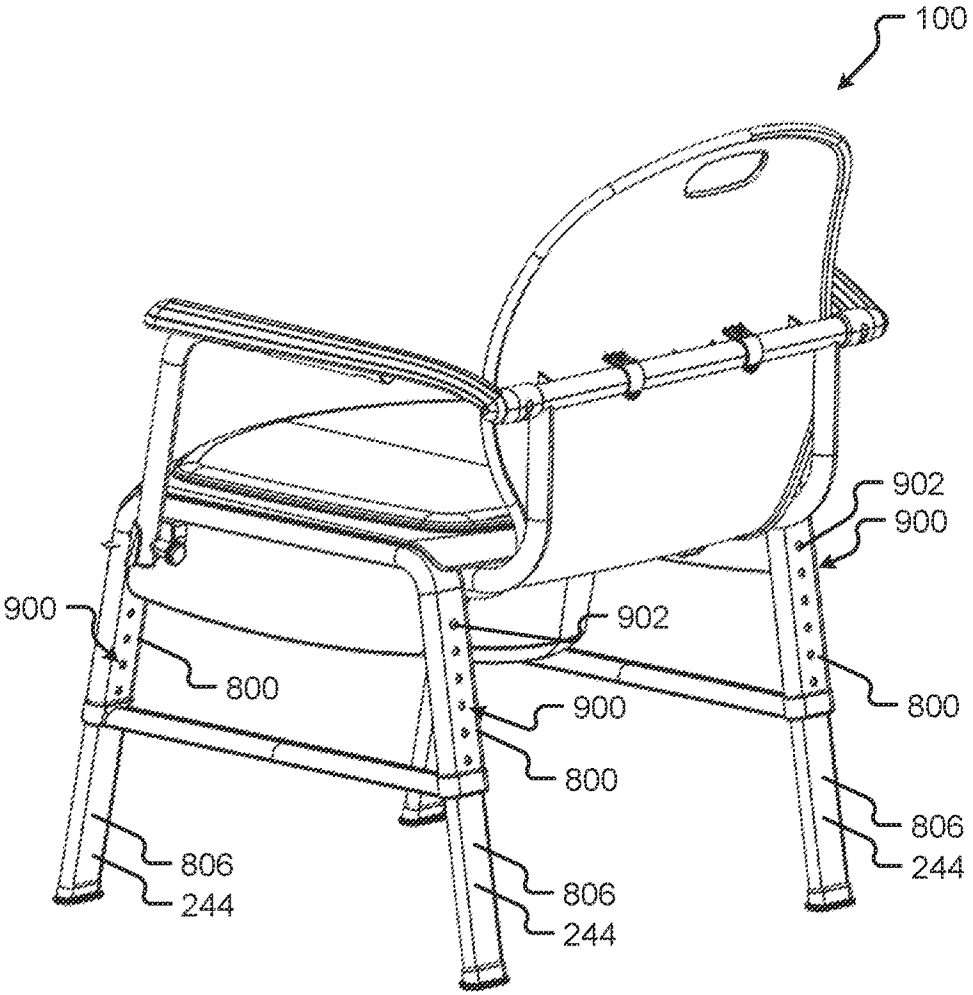
FIG. 9A is a rear perspective view of a commode in accordance with examples of the present disclosure.

Turning to FIGS. 9A and 9B, a rear perspective view of the commode 100 and a rear perspective exploded view of components of a leg assembly 204A, 204B are respectively shown. One leg 244 is shown in FIG. 9B for clarity. As illustrated, a plurality of apertures 900 are disposed on each of the outer tubes 800. In other examples, the plurality of apertures 900 may be disposed on the inner tube 806 or both the inner tube 806 and the outer tube 800. It will be appreciated that in some examples, the plurality of apertures 900 may comprise a plurality of notches, a plurality of slots, or a combination thereof. In the illustrated example, a pin 902 coupled to the inner tube 806 may be received in one of the plurality of apertures 900 to secure the inner tube 806 to the outer tube 800. In some examples, the pin 902 may be biased by, for example, a spring. In such examples, to adjust the inner tube 806 and the outer tube 800, the pin 902 is pushed inwards to disengage the pin 902 from a first aperture and the inner tube 806 and/or the outer tube 800 is moved until the pin 902 is aligned with a second aperture. When the pin 902 is aligned with the second aperture, the bias pushes the pin 902 into the second aperture. This process may be repeated for one or more legs 244 until a desired height of the commode 100 is obtained.

Figure 10:
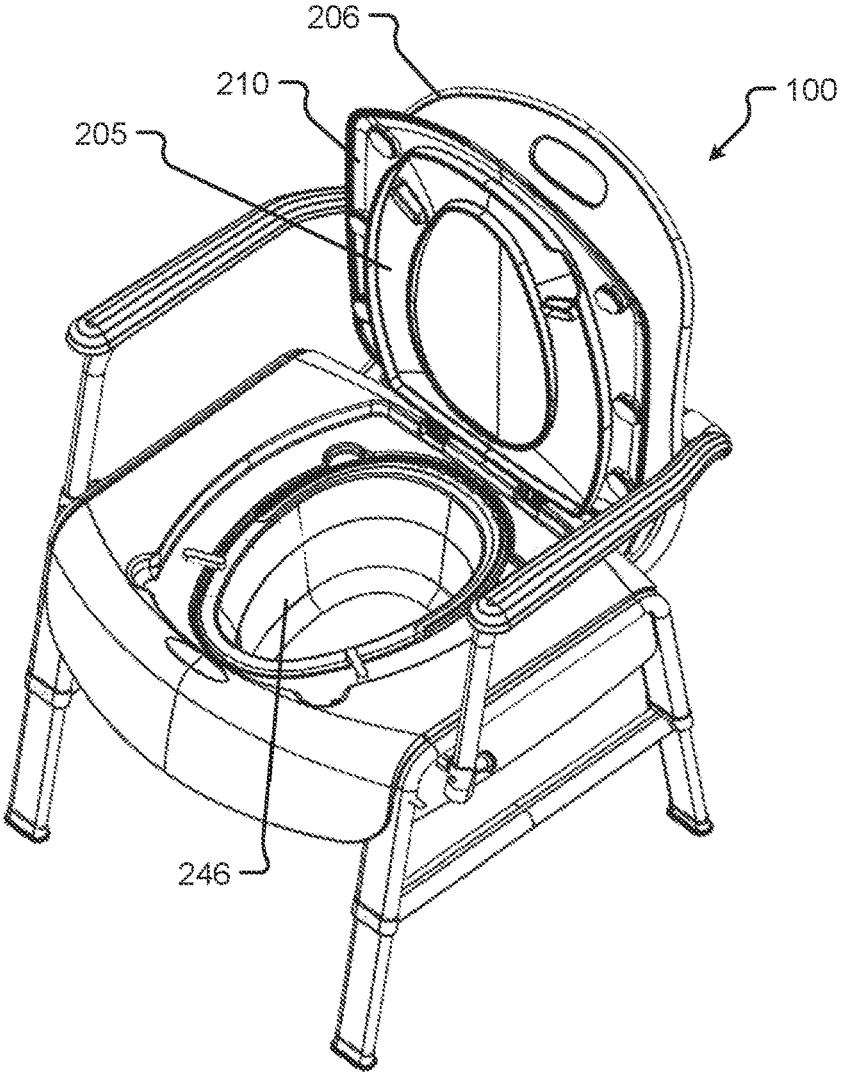
FIG. 10 is a top, tilted view of a commode in accordance with examples of the present disclosure.
Figure 11:
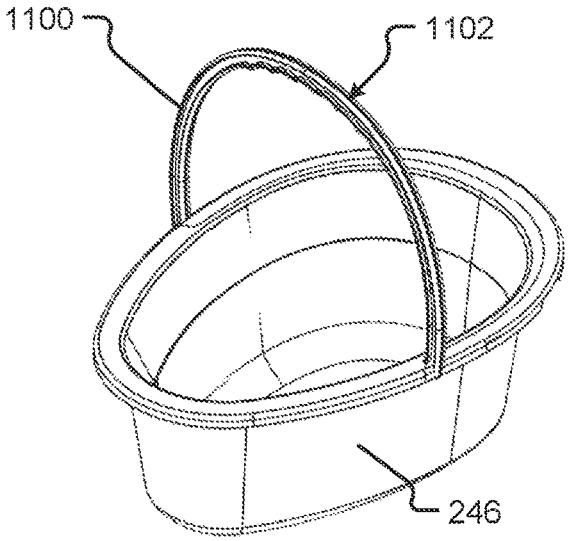
FIG. 11 is a perspective view of a bucket in accordance with examples of the present disclosure.

Turning to FIGS. 10 and 11, a top perspective view of the commode 100 and a perspective view of the bucket 246 are respectively shown. As mentioned above, the commode 100 may be configured to operate independently and/or interface with a toilet fixture. In particular, when interfacing and working with a toilet fixture, the commode 100 may be fitted with the splash guard 224 underneath the seat 205 and within the seat base 208. The splash guard 224 may fit underneath the opening of the seat 205 and extend through the seat base 208 such that when the commode 100 is positioned over a toilet fixture, the splash guard 224 extends into a bowl of the toilet fixture. The splash guard 224 may help direct fluid or the like into a bowl of a toilet fixture rather than splashing outside the bowl.

The same receptacle in the seat base 208 that receives the splash guard 224 may also be configured to receive the bucket 246. When operating independently, the commode 100 may be fitted with the bucket 246 rather than the splash guard 224. The bucket 246 may provide a basin for catching and holding fluid or the like if the commode 100 is not positioned over a toilet fixture 204. The bucket 246 may also include a handle 1100 that lies substantially flush with the top surface of the bucket 246 when situated within the seat base 208. The handle 1100 may then be used to lift the bucket 246 out of the commode 100. In some examples, the handle 1100 may include a number of indents 1102 and/or undulations that provide an ergonomic grip for the handle 1100 and that provide a point of hanging stabilization for the bucket 246 when the bucket 246 is hung from the handle 1100. For instance, when cleaning the bucket 246, it may be desirable to hang the bucket 246 from the handle 1100 over a sink faucet. The indents 1102 may be situated such that one of the indents 1102 is centered at the highest point of the bucket 246, thereby stabilizing the bucket 246 in a hanging position.

Figure 12:
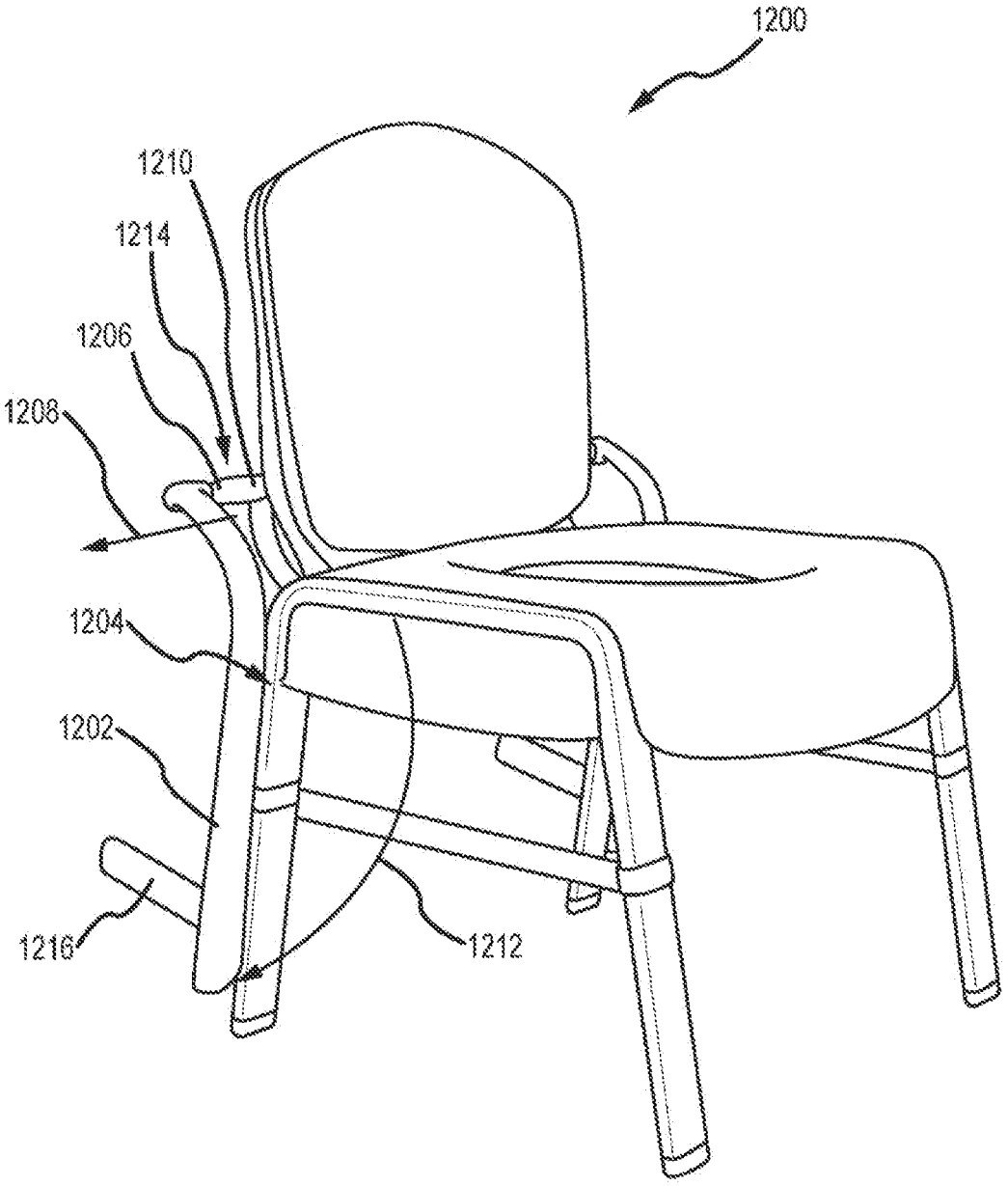
FIG. 12 is a perspective view of a commode with arm rests in a downward position in accordance with examples of the present disclosure.
Figure 13A:
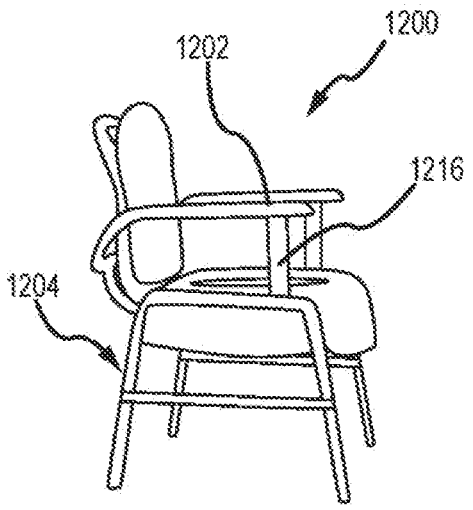
FIG. 13A is a side view of a commode in a first operational position in accordance with examples of the present disclosure.
Figure 13B:
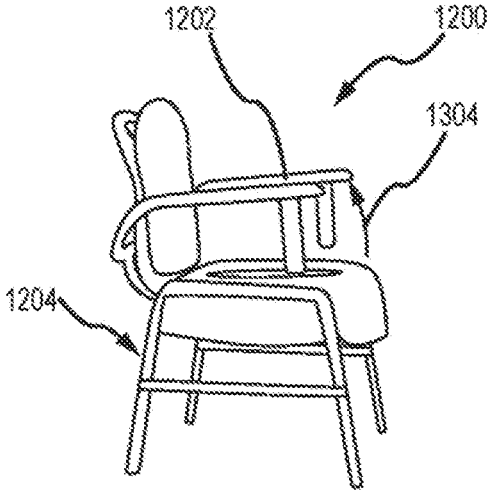
FIG. 13B is a side view of a commode in a second operational position in accordance with examples of the present disclosure.
Figure 13C:
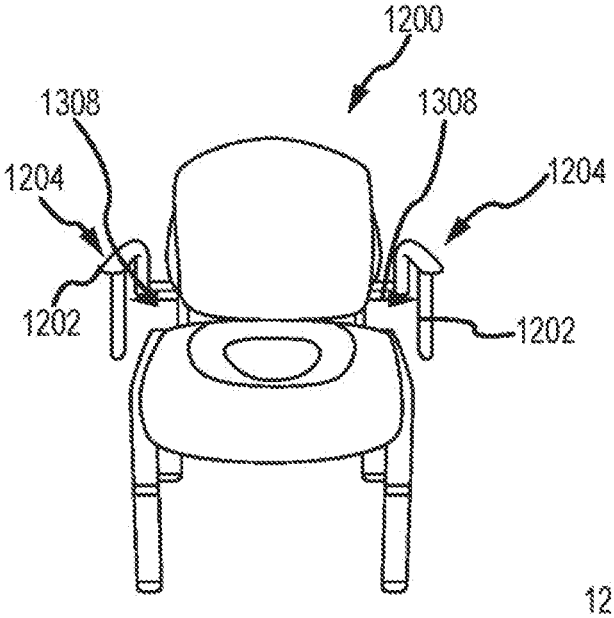
FIG. 13C is a side view of a commode in a third operational position in accordance with examples of the present disclosure.
Figure 13D:
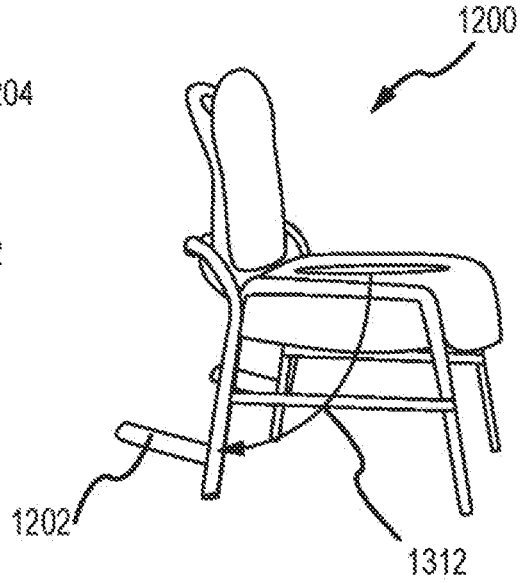
FIG. 13D is a side view of a commode in a fourth operational position in accordance with examples of the present disclosure.
Figure 14A:
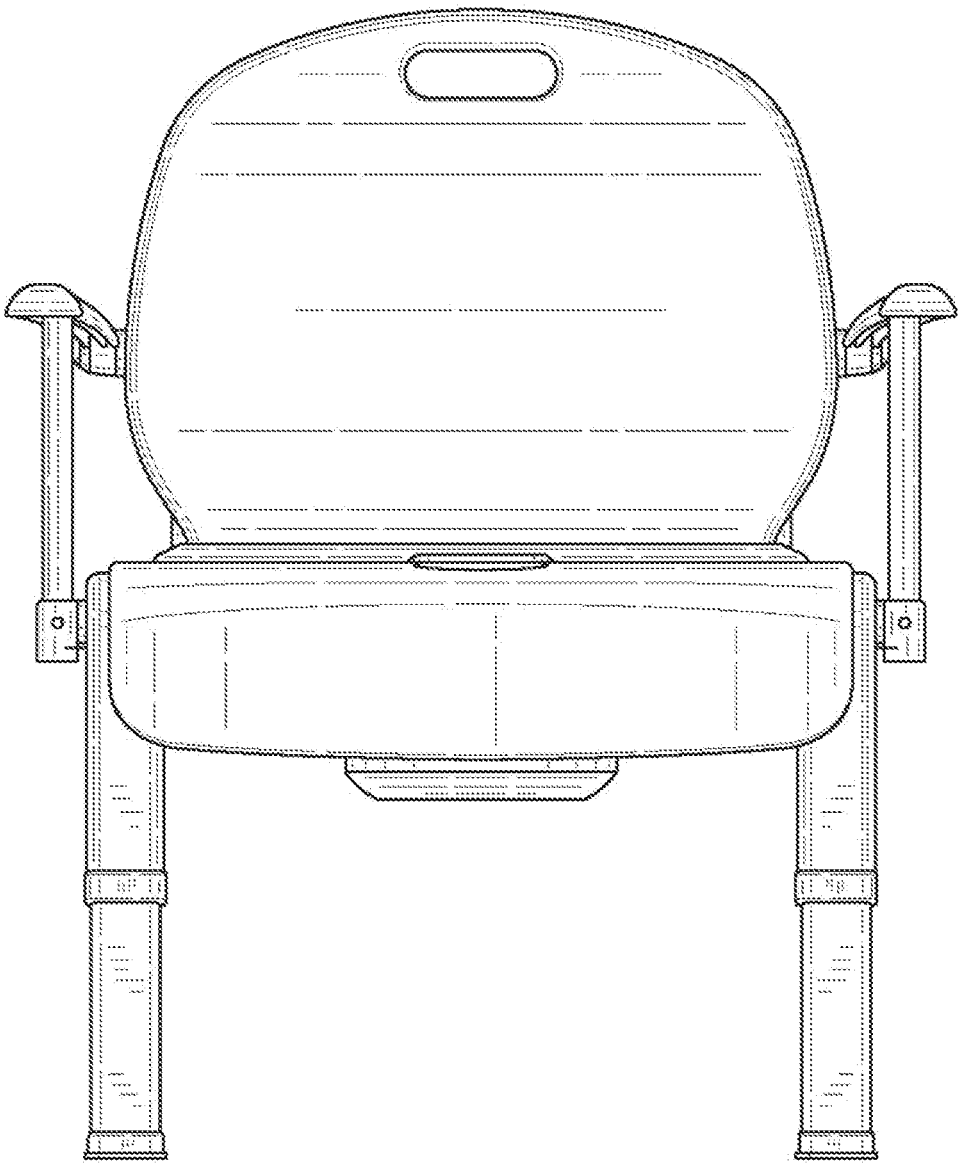
FIG. 14A is a front view of a commode in accordance with examples of the present disclosure.
Figure 14B:
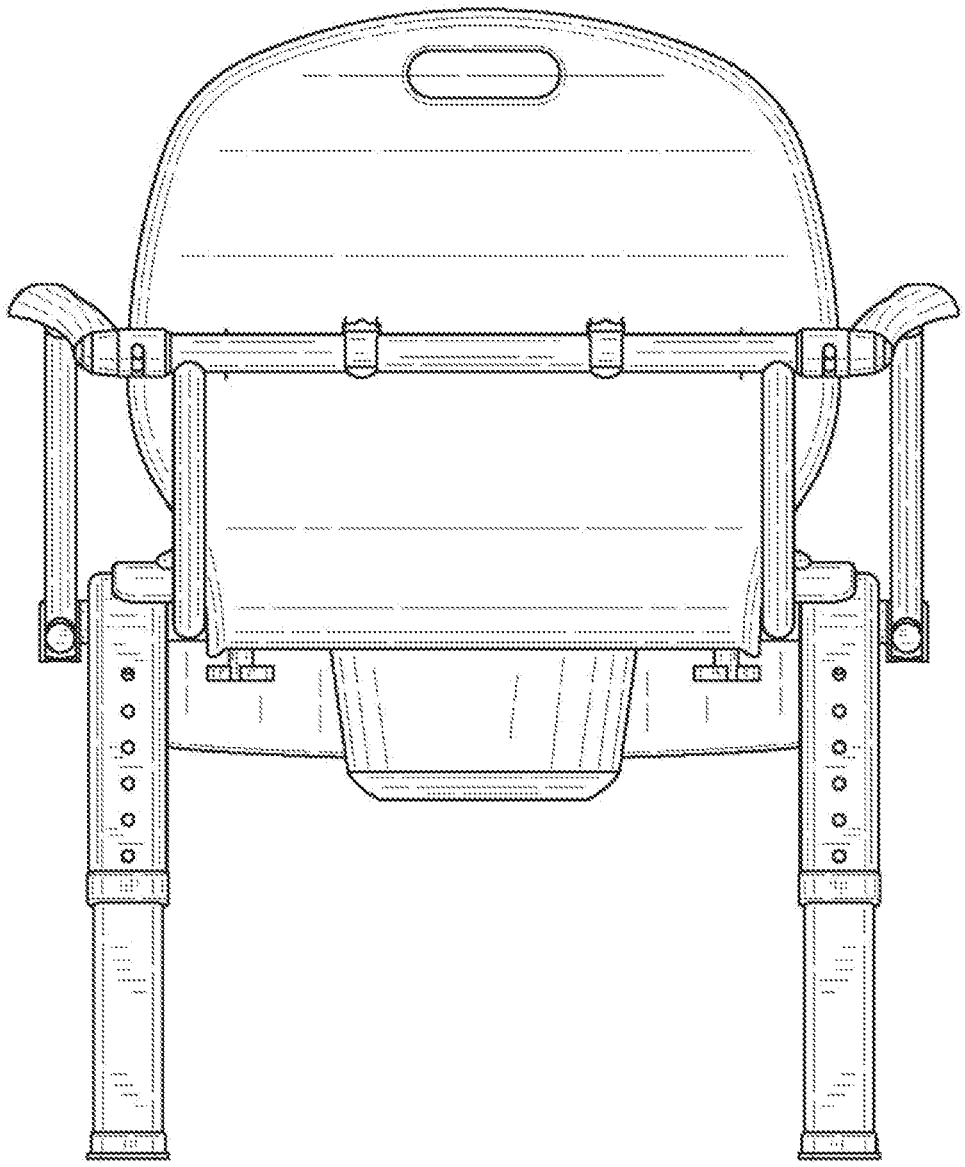
FIG. 14B is a rear view of a commode in accordance with examples of the present disclosure.
Figure 15A:
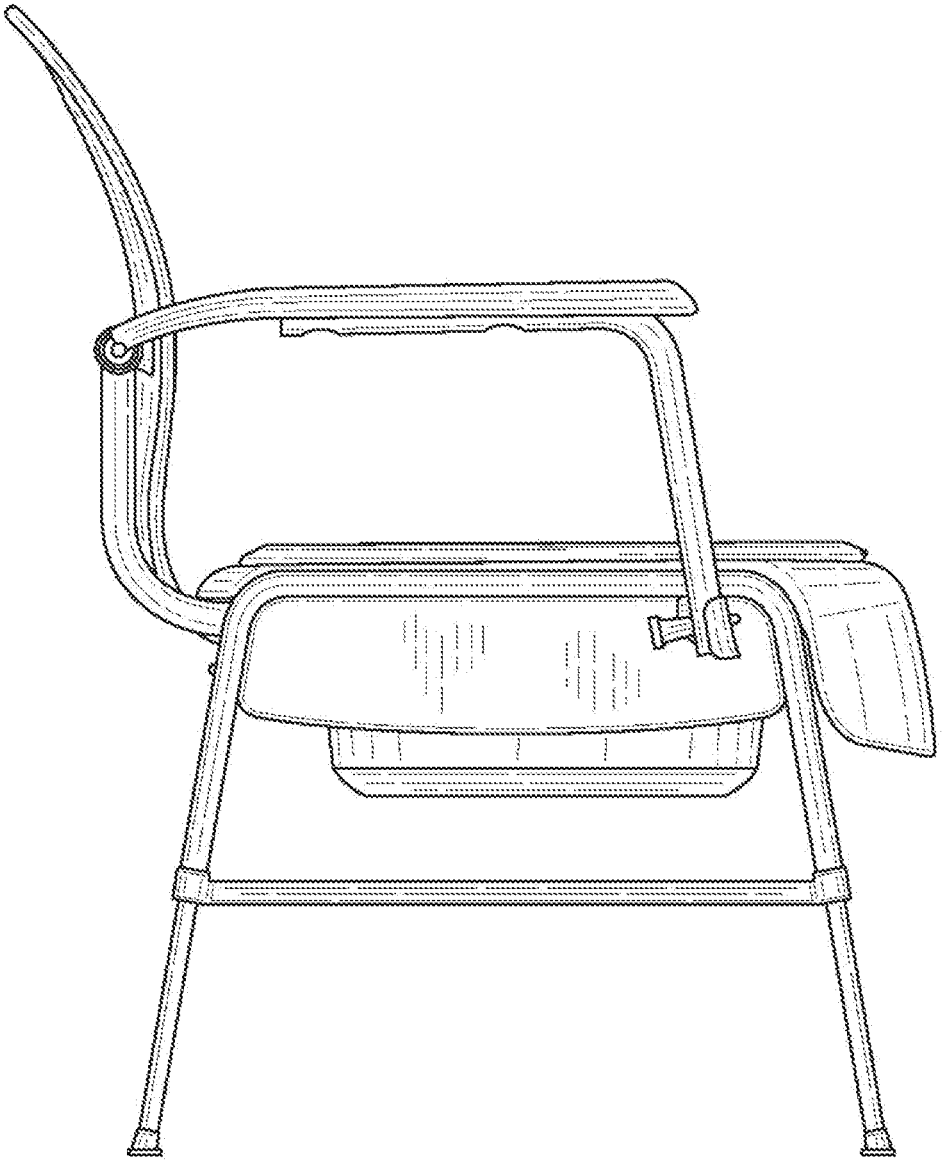
FIG. 15A is a left side view of a commode in accordance with examples of the present disclosure.
Figure 15B:
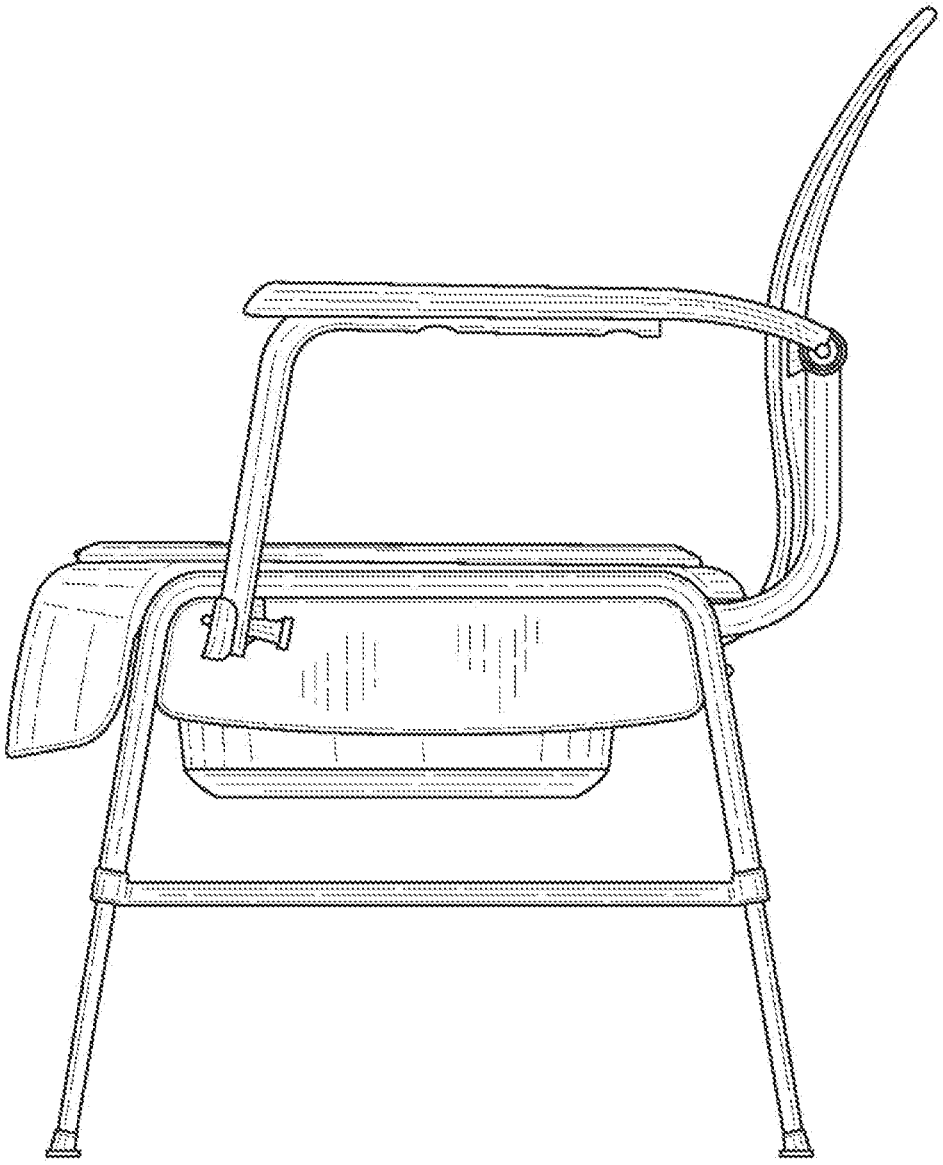
FIG. 15B is a right side view of a commode in accordance with examples of the present disclosure.
Figure 16A:
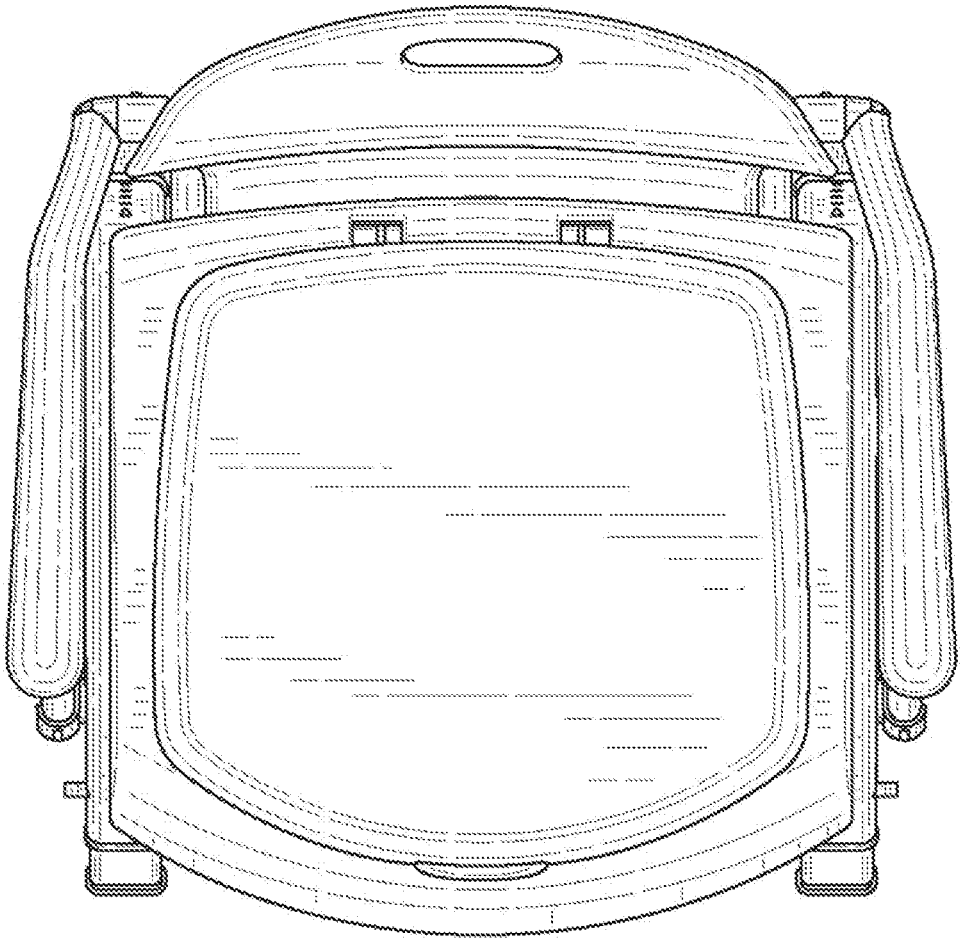
FIG. 16A is a top view of a commode in accordance with examples of the present disclosure.
Figure 16B:
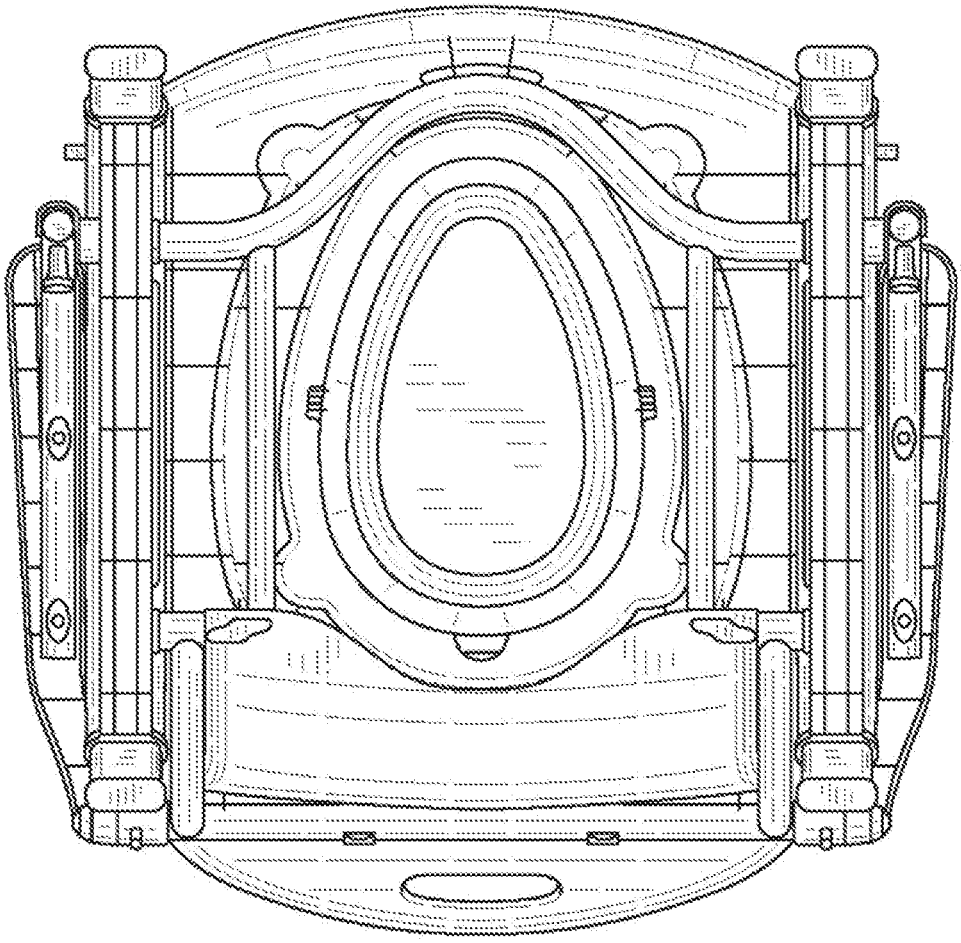
FIG. 16B is a bottom view of a commode in accordance with examples of the present disclosure.
Figure 17:
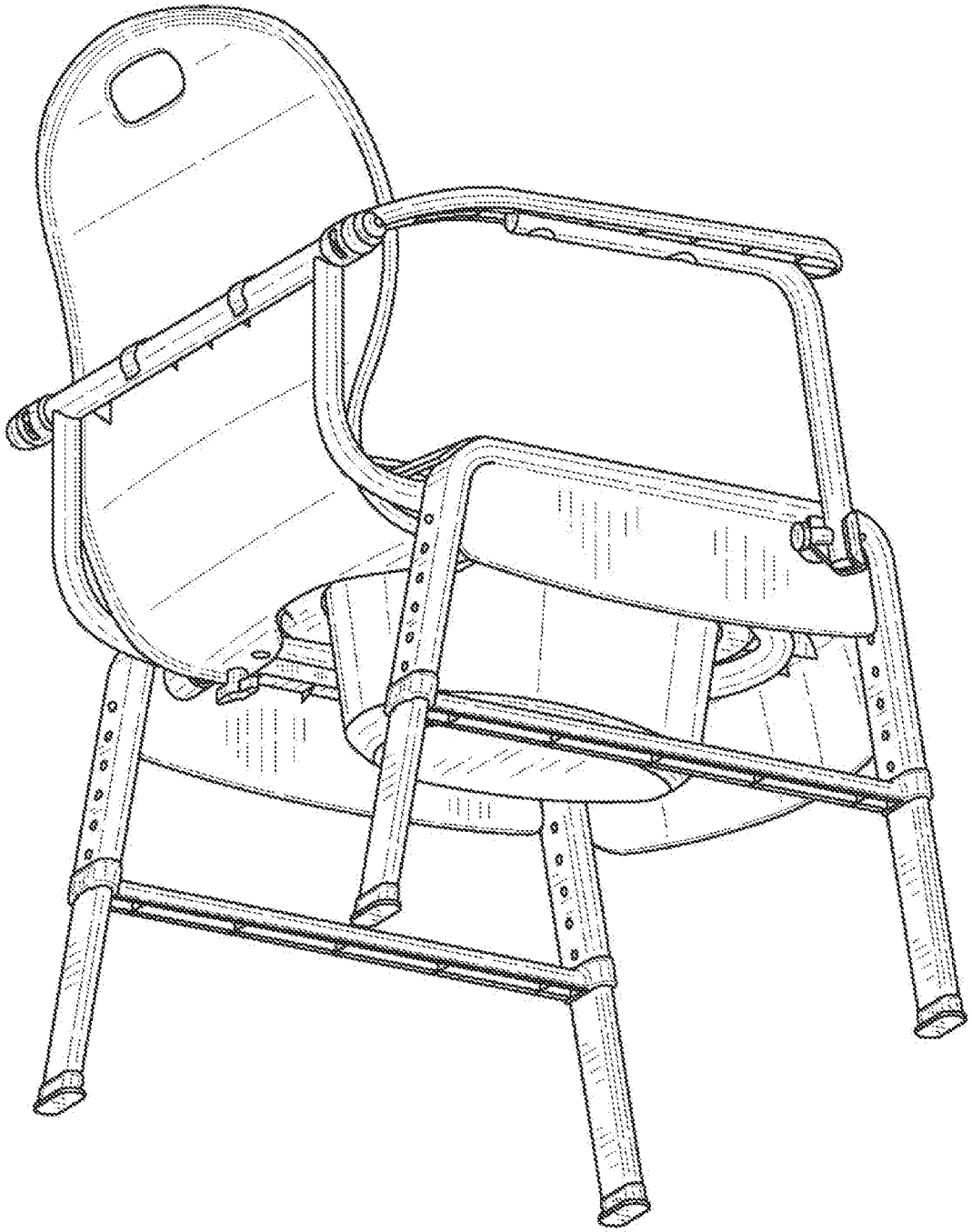
FIG. 17 is a bottom rear perspective view of a commode in accordance with examples of the present disclosure.
Figure 18:
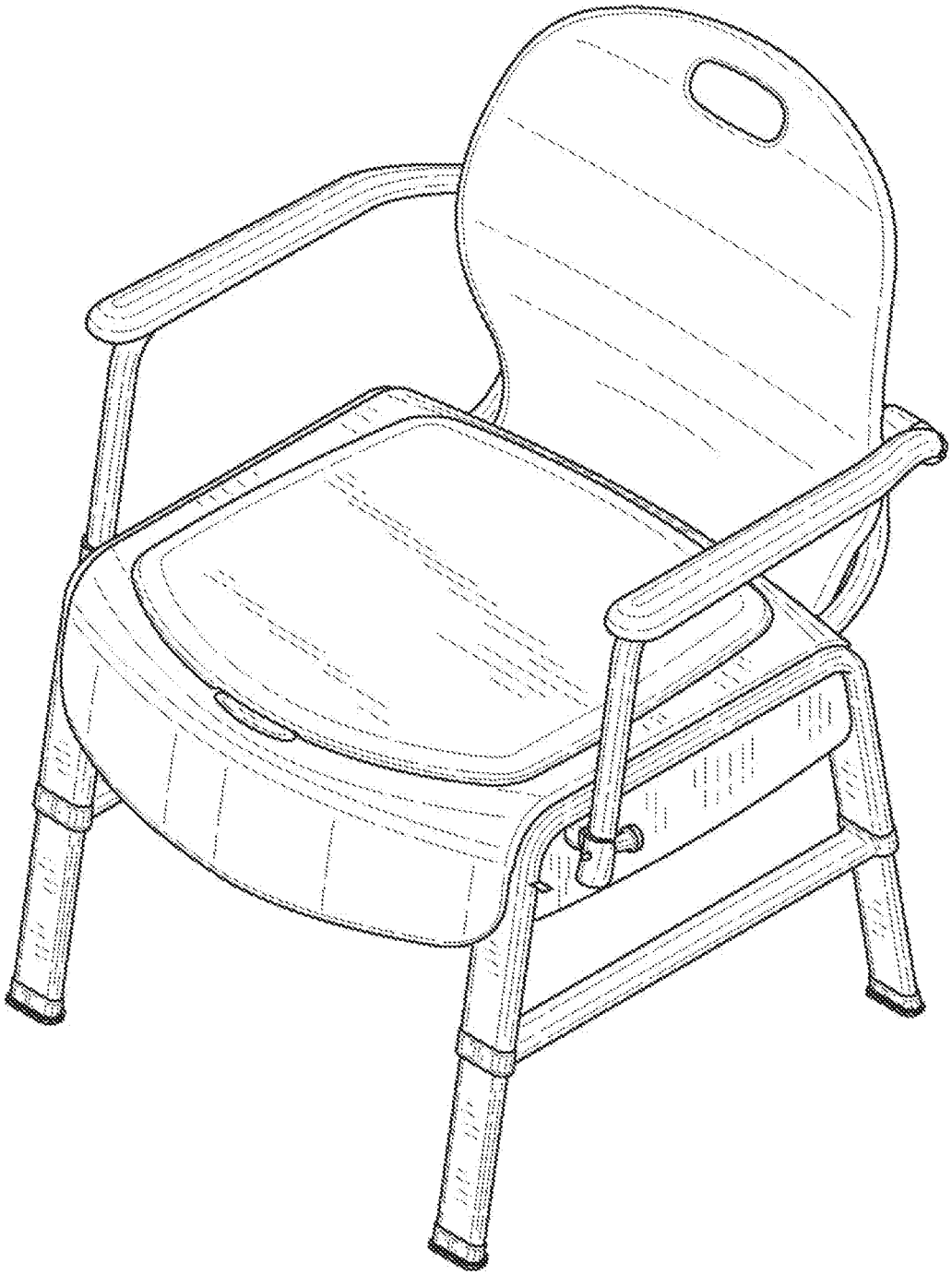
FIG. 18 is a perspective view of a commode in accordance with examples of the present disclosure.

Turning to FIG. 12, a commode 1200 according to another example of the present disclosure is provided. The commode 1200 includes two armrests 1202. While the commode 1200 is depicted as having two armrests 1202, it should be appreciated that the commode 1200 may include a single armrest 1202 or no armrests 1202 without departing from the present disclosure. In some configurations, the commode 1200 may include a first armrest 1202 (e.g., a left armrest 1202) and a second armrest 1202 (e.g., a right armrest 1202). The first armrest 1202 may be configured to rest upon the one leg assembly 1204 (e.g., the left leg assembly 1204) and rotate around an outer side of the left leg assembly 1204. Symmetrically, the second armrest 1202 may be configured to rest upon the other leg assembly 1204 (e.g., the right leg assembly 1204) and rotate around an outer side of the right leg assembly 1204. Components of the commode 1200 that facilitate the rotational and translational motion of the armrests 1202 about the leg assemblies 1204 will be described.

An armrest interface 1206 may enable the armrest 1202 to move relative to the leg assemblies 1204. In some examples, an armrest 1202 may be configured to slidably interface 1208 with a back tube 1210 at a pivot point 1214 and also move in a downward rotation 1212 relative to the leg assembly 1204 at the pivot point 1214. Both armrests 1202 may interface with the back tube 1210 at different pivot points 1214, but both pivot points 1214 may reside on a common axis of rotation, which passes through the central axis of the back tube 1210.

Turning to FIGS. 13A-13D, a tilted side view of the commode 1200 with the armrest 1202 in a first position, a tilted side view of the commode 1200 with the armrest 1202 in a second position, a front tilted view of the commode 1200 with the armrest 1202 in a second position, and a tilted side view of the commode 1200 with the armrest 1202 in a third position are respectively shown. In some examples, the armrest interface 1206 may include a slot and pin configuration in which the armrest 1202 is provided with a pin and the back tube 1210 is provided with a U-shaped slot that receives the pin of the armrest 1202. The pin and U-shaped slot may enable a support 1216 of the armrest 1202 to rest upon the leg assembly 1204 in a first operational position (see FIG. 13A). A user may then upwardly rotate 1304 the armrest 1202 relative to the leg assembly 1204 (see FIG. 13B). This upward rotation 1304 may be enabled by the shape slot provided in the back tube 1210. Once upwardly rotated, the armrest 1202 may be allowed to slide 1308 outward, again under guidance of the slot provided in the back tube 1210 (see FIG. 13C). After the armrest 1202 has reached the end of the sliding motion 1308, the armrest 1202 may be extended beyond the side of the leg assembly 1204 and allowed to move in a downward rotation 1312 (see FIG. 13D). During the downward rotation 1312, the armrest 1202 may rotate around the outside of the leg assembly 1204 until reaching a resting or second position. In this position, the armrest 1202 may be positioned behind the leg assembly 1204, thereby allowing a user to clean themselves, move onto the seat 205, or move off of the seat 205 without hindrance of the armrest 1202.

FIGS. 14A-18 show additional views of the commode 100 for illustrative purposes.

As should be appreciated by one skilled in the art, aspects of the present disclosure have been illustrated and described herein in any of a number of patentable classes or context including any new and useful process, machine, manufacture, or composition of matter, or any new and useful improvement thereof.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

A number of implementations have been described. Nevertheless, it will be understood that additional modifications may be made without departing from the scope of the inventive concepts described herein, and, accordingly, other examples are within the scope of the following claims.

What is claimed is:

1. A commode, comprising:

a seat comprising an opening therein;

a seat base connected with the seat and configured to allow the seat to move between an open position and a closed position, the seat base includes a cascading seat front that transitions downwardly from a plane that is substantially parallel with the seat when the seat is in the closed position;

a leg assembly configured to support the seat base, wherein the leg assembly is configured to adjust a height of the seat base; and an armrest configured to at least partially rotate about the seat base and the leg assembly.

2. The commode of claim 1, further comprising:

a back tube connected with the leg assembly, wherein the back tube is configured to receive the armrest and provide a pivot point for the armrest.

3. The commode of claim 2, wherein the leg assembly comprises a first leg assembly and a second leg assembly, wherein the armrest comprises a first armrest and a second armrest, wherein the first armrest is configured to rest upon the first leg assembly and rotate around an outer side of the first leg assembly, and wherein the second armrest is configured to rest upon the second leg assembly and rotate around an outer side of the second leg assembly.

4. The commode of claim 2, further comprising:

a backrest that is configured to interface with the seat base and is further configured to be supported by the back tube.

5. The commode of claim 1, wherein the seat base is connected with the seat by a hinge.

6. The commode of claim 1, further comprising:

a splash guard that sits beneath the seat and within the seat base, wherein the splash guard is further configured to extend through the seat base.

7. The commode of claim 1, further comprising:

a bucket that sits beneath the seat and within the seat base, wherein the bucket is further configured to extend through the seat base.

8. The commode of claim 7, wherein the bucket comprises a handle and wherein the handle comprises one or more indents that provide an ergonomic grip for the handle and that provide a point of hanging stabilization for the bucket when the bucket is hung from the handle.

9. The commode of claim 1, further comprising:

a lid connected to the seat base and movable between an open position and a closed position, wherein the lid covers the seat when in the closed position.

10. A commode, comprising:

a seat frame;

a seat comprising an opening therein;

a seat base supported on the seat frame and connected with the seat, the seat base configured to allow the seat to move between an open position and a closed position;

a leg assembly configured to support the seat base, wherein the leg assembly is configured to adjust a height of the seat base; and an armrest configured to at least partially rotate about the seat base and the leg assembly, wherein the armrest is releasably secured to a receiver fixed to the seat frame by a trigger.

11. The commode of claim 10, wherein the receiver comprises an aperture and the trigger comprises a biased pin receivable in the aperture, and wherein the armrest is rotatable when the pin is not positioned in the aperture and the armrest is fixed when the pin is positioned in the aperture.

12. The commode of claim 11, wherein the trigger further comprises a knob, wherein the trigger is actuated when a force is applied to the knob to pull the knob away from the receiver, wherein when the force applied to the knob exceeds a biasing force, the pin is pulled away from the receiver.

13. The commode of claim 10, wherein the leg assembly comprises a leg having an inner tube slidable in an outer tube, a plurality of apertures disposed on the outer tube, and a biased pin coupled to the inner tube, and wherein the biased pin is configured to be received by one of the plurality of apertures to lock the inner tube to the outer tube.

14. The commode of claim 10, further comprising a lid connected to the seat base and movable between an open position and a closed position, wherein the lid covers the seat when in the closed position.

15. The commode of claim 14, wherein the lid comprises a plurality of grips for increasing friction at an interface between the lid and the seat.

16. The commode of claim 10, further comprising:

a bucket that sits beneath the seat and within the seat base, wherein the bucket is further configured to extend through the seat base.

17. A commode, comprising:

a seat frame comprising a first curved tube coupled to a second curved tube by at least one cross tube and a back tube coupled to the second curved tube by at least one lateral tube;

at least one leg assembly comprising a leg having an adjustable height;

a seat assembly supported by the seat frame and the at least one leg assembly, the seat assembly comprising a seat pivotably coupled to a seat base and a backrest; and at least one arm rest assembly supported by the seat frame, the at least one arm rest assembly comprising an arm rest frame pivotably coupled to the back tube and releasably securable to the first curved tube.

18. The commode of claim 17, wherein the backrest is configured to be removable from the seat frame, and wherein the backrest comprises at least one bracket to secure the backrest to the back tube and at least one fastener to secure the backrest to the second curved tube.

19. The commode of claim 17, further comprising a splash guard fitted within the seat base and under the seat.

20. The commode of claim 17, wherein the seat base comprises a seating surface and a front lip curving downward from the seating surface, the front lip configured to at least partially cover a view of a toilet fixture when the commode is fixed to a toilet fixture.

* * * * *